US007878117B2

(12) United States Patent
Katoh et al.

(10) Patent No.: US 7,878,117 B2
(45) Date of Patent: Feb. 1, 2011

(54) STENCIL PRINTING APPARATUS HAVING CONTROLLED THERMAL HEAD FOR PERFORATING STENCIL

(75) Inventors: Satoshi Katoh, Miyagi (JP); Kengo Tsubaki, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 274 days.

(21) Appl. No.: 12/026,047

(22) Filed: Feb. 5, 2008

(65) Prior Publication Data

US 2008/0302259 A1 Dec. 11, 2008

(30) Foreign Application Priority Data

Jun. 5, 2007 (JP) ..... 2007-149677

(51) Int. Cl.
*B41L 13/04* (2006.01)
*B41J 3/24* (2006.01)

(52) U.S. Cl. ..... 101/128.4; 101/116; 101/128.21

(58) Field of Classification Search ..... 101/116, 101/128.4, 128.21; 347/180, 182
See application file for complete search history.

(56) References Cited

U.S. PATENT DOCUMENTS 4,251,822 A * 2/1981 Hara et al. ..... 346/139 C
4,492,482 A * 1/1985 Eguchi et al. ..... 358/1.8
4,779,102 A * 10/1988 Sasaki ..... 347/180
5,809,879 A 9/1998 Yokoyama et al.
6,130,697 A 10/2000 Yokoyama et al.
6,664,992 B1 12/2003 Yokoyama et al.
6,747,682 B2 6/2004 Kidoura et al.
6,836,276 B2 12/2004 Kidoura et al.
2006/0075914 A1 4/2006 Kawano
2006/0219106 A1 10/2006 Sato
2006/0266233 A1 * 11/2006 Nagai ..... 101/119

FOREIGN PATENT DOCUMENTS

JP 2001328332 A * 11/2001
JP 2004-136672 5/2004
JP 2006-281658 10/2006

* cited by examiner

*Primary Examiner*—Leslie J Evanisko
(74) *Attorney, Agent, or Firm*—Oblon, Spivak, McClelland, Maier & Neustadt, L.L.P.

(57) ABSTRACT

A stencil printing apparatus with a plate-making device has first control means for executing a special plate-making mode for performing a plate-making operation so that perforated holes to be formed in a film of a master by heating and driving with regard to odd bits corresponding to odd-numbered heat generators and even bits corresponding to even-numbered heat generators are formed in different lines running in the main scanning direction, and so that the perforated holes to be formed on the film by heating and driving with regard to the odd bits and the even bits adjacent to each other are not arranged adjacent to each other in the same line in the main scanning direction.

12 Claims, 12 Drawing Sheets

BACKGROUND - COMPARATIVE EXAMPLE

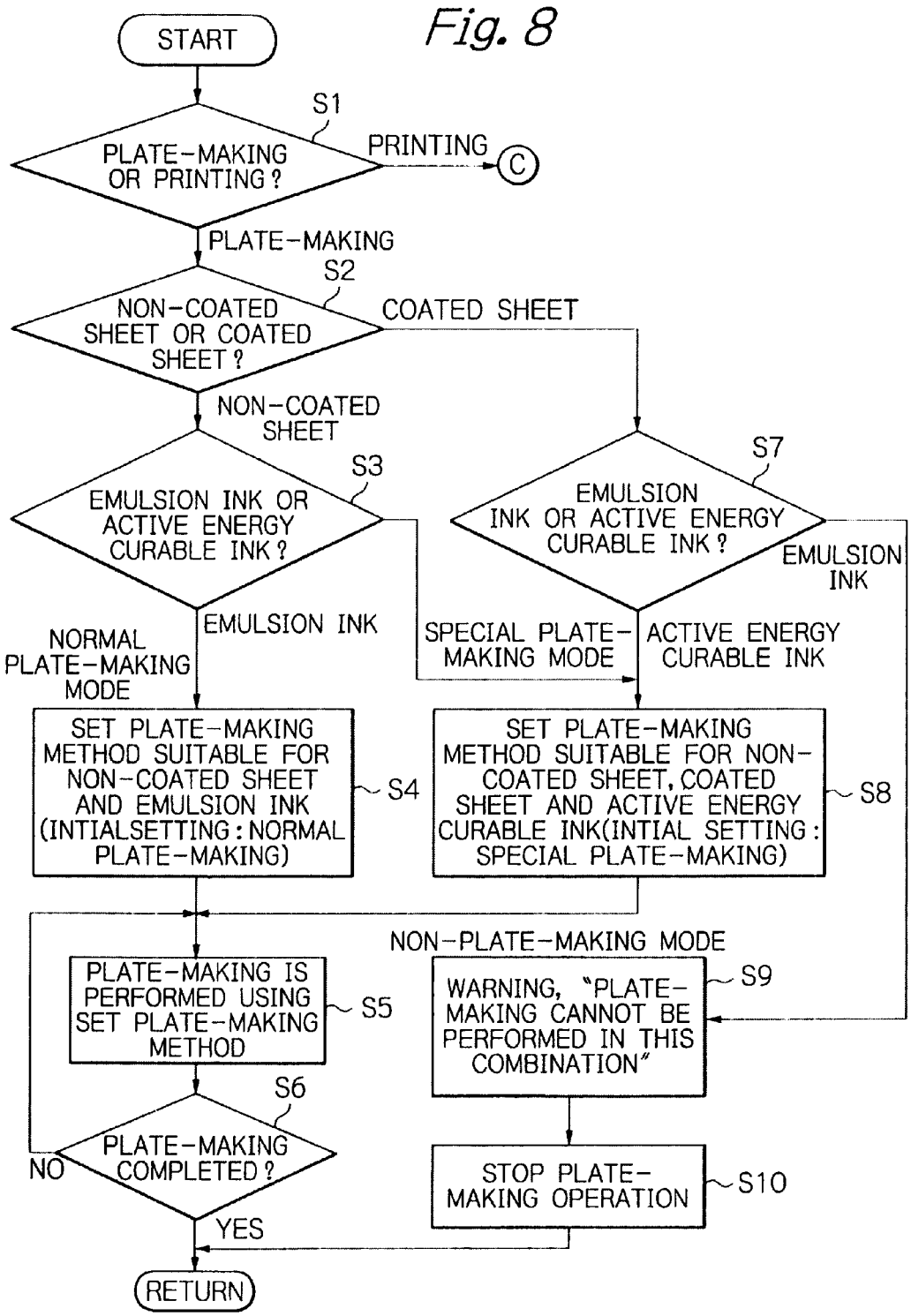
Fig. 8
START
S1
PLATE-MAKING OR PRINTING ?
PRINTING
C
PLATE-MAKING
S2
NON-COATED SHEET OR COATED SHEET ?
COATED SHEET
NON-COATED SHEET
S3
EMULSION INK OR ACTIVE ENERGY CURABLE INK ?
S7
EMULSION INK OR ACTIVE ENERGY CURABLE INK ?
EMULSION INK
EMULSION INK
NORMAL PLATE-MAKING MODE
SPECIAL PLATE-MAKING MODE
ACTIVE ENERGY CURABLE INK
SET PLATE-MAKING METHOD SUITABLE FOR NON-COATED SHEET AND EMULSION INK (INTIALSETTING : NORMAL PLATE-MAKING)
S4
SET PLATE-MAKING METHOD SUITABLE FOR NON-COATED SHEET, COATED SHEET AND ACTIVE ENERGY CURABLE INK(INTIAL SETTING : SPECIAL PLATE-MAKING)
S8
NON-PLATE-MAKING MODE
PLATE-MAKING IS PERFORMED USING SET PLATE-MAKING METHOD
S5
WARNING, "PLATE-MAKING CANNOT BE PERFORMED IN THIS COMBINATION"
S9
S6
PLATE-MAKING COMPLETED ?
NO
STOP PLATE-MAKING OPERATION
S10
YES
RETURN

BACKGROUND - COMPARATIVE EXAMPLE

STENCIL PRINTING APPARATUS HAVING CONTROLLED THERMAL HEAD FOR PERFORATING STENCIL

BACKGROUND OF THE INVENTION

1. Field of the Invention

The present invention relates to a stencil printing apparatus with a plate-making device.

2. Description of the Related Art

As a simple printing system, there is known a digital heat-sensitive stencil printing apparatus (called "stencil printing apparatus" hereinafter) equipped with a digital heat-sensitive plate-making device. In this plate-making device, a thermal head having a plurality of heat generators, referred to as heat generating elements or heat generating resistors, arranged in a main scanning direction and a platen roller are used to press a heat-sensitive stencil master (simply called "master" hereinafter) having a thermoplastic resin film (simply called "film" hereinafter), and in the meantime the master is relatively moved in a sub-scanning direction perpendicular to the main scanning direction, by rotating the platen roller, and then a perforated/plate-making image with dots (perforated pattern) is formed on the master by means of the heat generated by each of the heat generators of the thermal head in response to an image signal.

In a general stencil printing apparatus, after the engraved master on which the perforated/plate-making image is formed using the plate-making device as described above is wound around the outer periphery of a plate cylinder, the plate cylinder is rotated to convey a print sheet, which is a medium to be printed (simply called "sheet" hereinafter), to the space between the plate cylinder and a pressing member such as a press roller or an impression cylinder at predetermined timing in synchronization with the rotational movement of the plate cylinder. Then, the pressing member pressure-welds the sheet to the engraved master on the plate cylinder, and ink supplied into the plate cylinder is caused to bleed from an opening portion of the plate cylinder, a mesh screen and a perforated portion of the master and then shifted/transferred to the sheet, whereby the sheet is obtained as a printed matter.

Thereafter, the printed matter with the transferred plate-making image is delivered to a sheet delivery table and stacked sequentially thereon. The ink used in the general stencil printing apparatus is emulsion ink, which cannot be fixed immediately after transferred to the sheet. The printed matter is normally dried naturally, i.e., as the ink is absorbed into the sheet over time. In other words, the printed matter is dried naturally. Specifically, if regular print ink is used when executing stencil printing, the ink is infiltrated and dried, causing offset and bleeding, and thus it is generally difficult to obtain a good double-sided printed matter using the regular ink. Moreover, the regular ink is not dried easily on art paper or coated sheet with a shiny surface, hence, even when single-side printing is performed, it is difficult to obtain a good single-sided printed matter.

Therefore, there is proposed an apparatus for performing double-side printing using a stencil or stencil printing on art sheet or coated sheet by using photo-curable ink (ultraviolet light) which is active energy ray curable ink, and light (ultraviolet light) irradiation means, which is active energy ray irradiation means (see Japanese Published Unexamined Patent Application No. 2004-136672 and Japanese Published Unexamined Patent Application No. 2006-281658, for example).

However, use of active energy ray curable ink and printing on coated sheet are not taken into consideration in the general stencil printing apparatus, because printing using both the active energy ray curable ink and coated sheet has problems of printing wrinkles and master wrinkles that cause image defects such as white stripes generated due to floating of an engraved master.

SUMMARY OF THE INVENTION

The present invention, therefore, was contrived in view of the above-described circumstances, and a main object of the present invention is to realize and provide a stencil printing apparatus capable of obtaining an optimal printed image quality without causing printing wrinkles (image defects such as white stripes) and master wrinkles that are generated due to floating of an engraved master, even if the ink to be used in the stencil printing apparatus is emulsion ink or active energy ray curable ink used for stencil printing, and even if the medium to be printed used in the stencil printing apparatus is a non-coated sheet such as high-quality sheet, or a coated sheet.

In an aspect of the present invention, there is provided with a stencil printing apparatus, in which a thermal head having a number of heat generators arranged in a main scanning direction is directly brought into contact with a thermoplastic resin film of a master, and the thermoplastic resin film is subjected to melt perforation by regioselectively heating and driving each of the heat generators in response to an image signal, while relatively moving the master in a sub-scanning direction perpendicular to the main scanning direction, to obtain a perforated pattern corresponding to the image signal, then the engraved master on which the perforated pattern is formed is wound around an outer peripheral surface of a print drum, ink is supplied from an inner periphery side of the print drum, an ink image corresponding to the image signal is formed on a medium to be printed by means of ink bleeding through the perforated pattern, and the ink image is completely fixed using active energy ray curable ink as the ink. The stencil printing apparatus has a first control device for controlling the thermal head so that perforated holes to be formed in the thermoplastic resin film by heating and driving with regard to odd bits corresponding to odd-numbered heat generators and even bits corresponding to even-numbered heat generators are formed in different lines running in the main scanning direction, and so that the perforated holes to be formed in the thermoplastic resin film by heating and driving with regard to the odd bits and the even bits adjacent to each other are not arranged adjacent to each other in the same line in the main scanning direction.

BRIEF DESCRIPTION OF THE DRAWINGS

The above and other objects, features and advantages of the present invention will become more apparent from the following detailed description taken with the accompanying drawings in which:

FIG. 8 is a flowchart showing a plate-making operation of the present embodiment;

DESCRIPTION OF THE PREFERRED EMBODIMENTS

Figure 1:
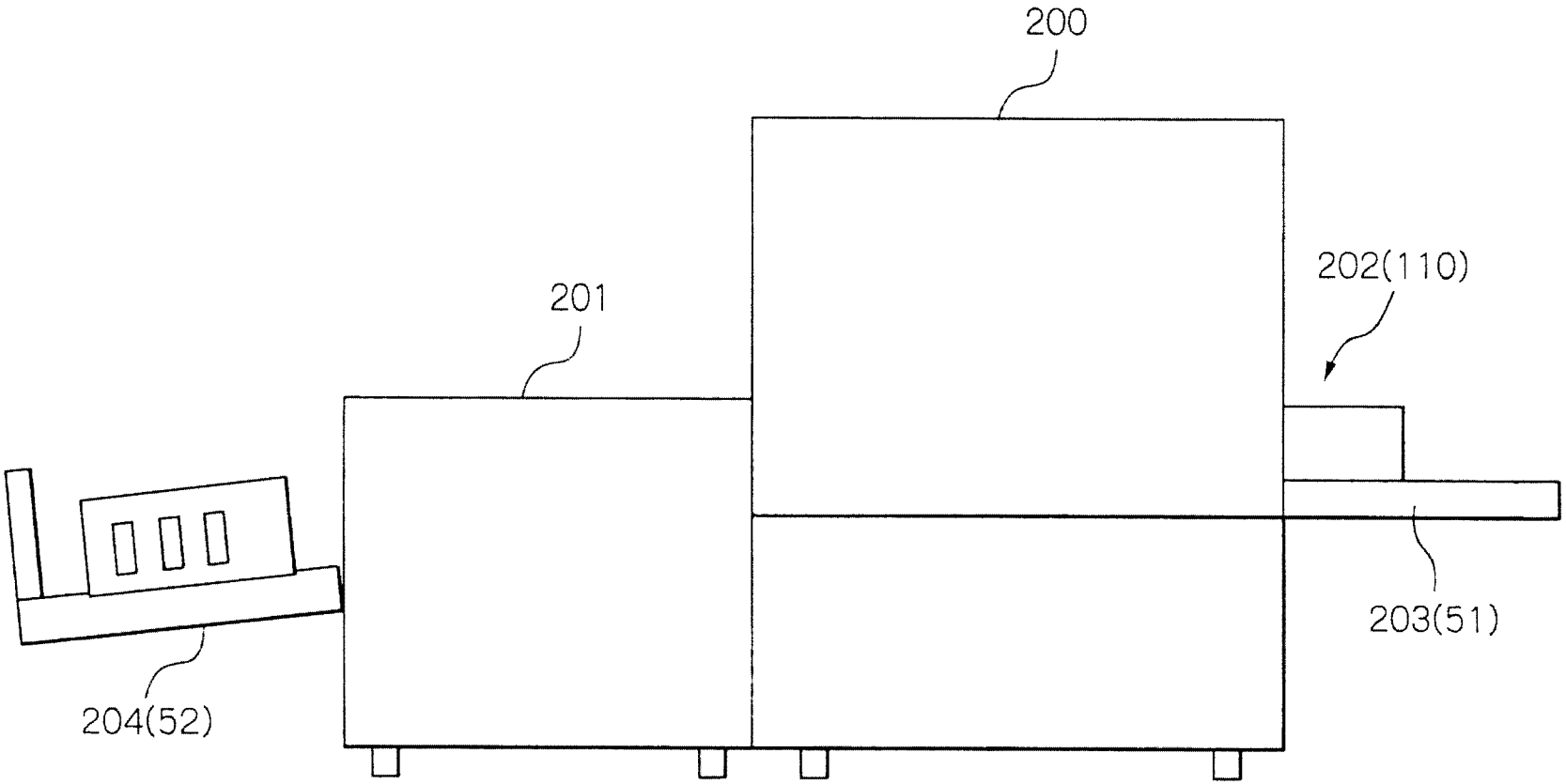
FIG. 1 is a schematic front view of a stencil printing apparatus according to an embodiment of the present invention.

Hereinafter, an embodiment of the present invention including the best mode for carrying out the present invention and examples will be described with reference to the drawings. Throughout the embodiments, a modification and the like, the same reference numerals are applied to the components such as the members and component parts having the same functions and shapes, hence redundant explanations are omitted. If it is not necessary to particularly explain some components shown in the drawings, such explanations are omitted in order to simplify the drawings and descriptions. When explaining the components of the present invention by directly quoting the components used in the publications of unexamined patent applications, reference numerals for these components are described using parentheses in order to distinguish them from the components of the embodiments and the like.

Figure 2:
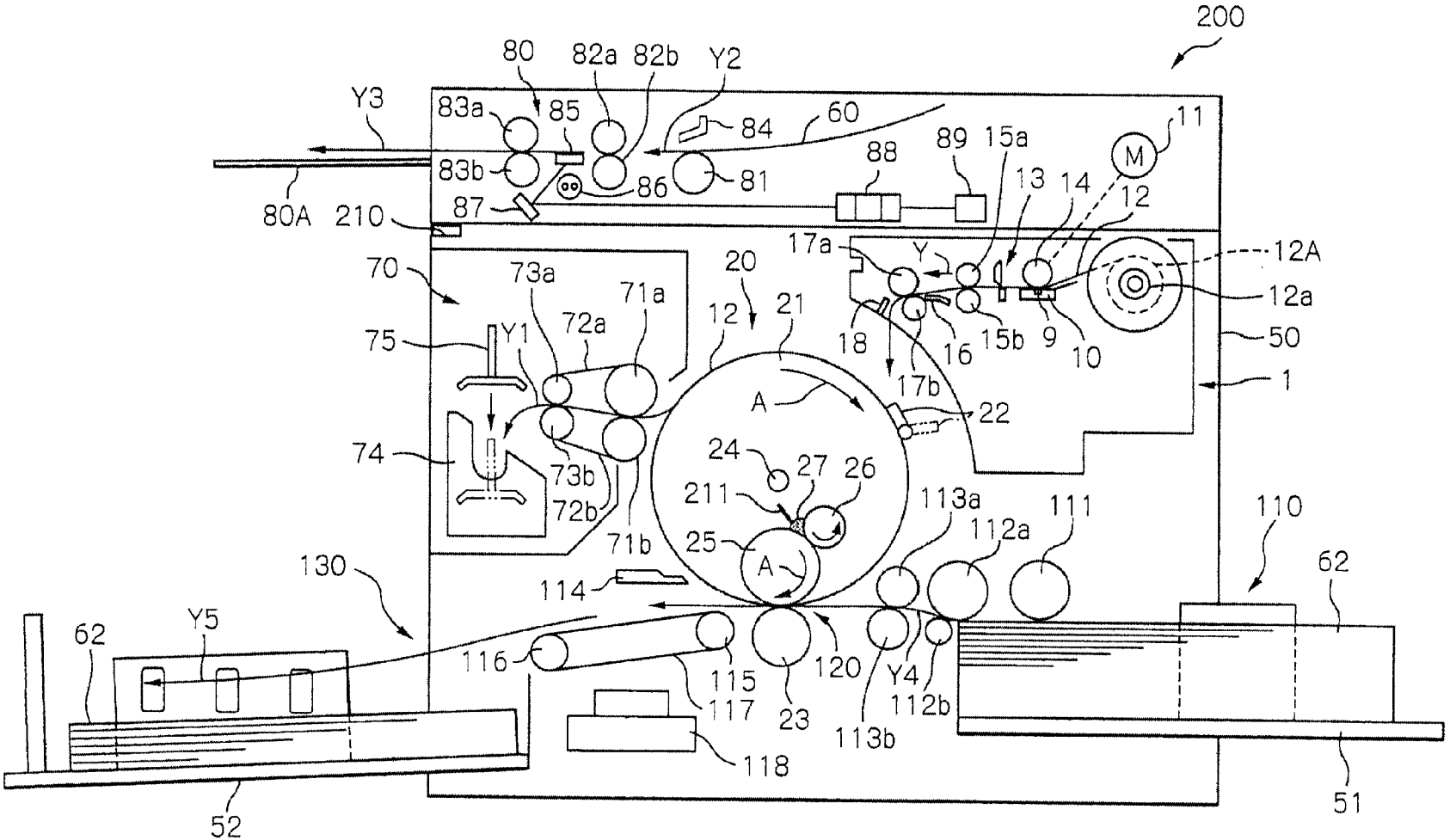
FIG. 2 is a front view showing the entire configuration of the stencil printing apparatus main body shown in FIG. 1.

FIG. 1 is a diagram schematically showing the entire configuration of a digital heat-sensitive stencil printing apparatus according to an embodiment of the present invention, and FIG. 2 shows the entire configuration of, mainly, the digital heat-sensitive stencil printing apparatus main body shown in FIG. 1.

Because active energy ray curable ink can be used in the present embodiment, an active energy ray curing fixing device 201 for curing the active energy ray curable ink is provided laterally on the sheet delivery side of the stencil printing apparatus of FIG. 1. Ultraviolet curable ink, for example, is used as the active energy ray curable ink, and an ultraviolet curing fixing device, for example, is used as the active energy ray curing fixing device.

In FIG. 1, reference numeral 200 indicates the stencil printing apparatus main body, which is illustrated in detail in FIG. 2, and a sheet feeding portion 202 is provided to the right of the stencil printing apparatus main body 200. As described above, the active energy ray curing fixing device 201 is provided laterally on the sheet delivery side of the stencil printing apparatus main body 200. This active energy ray curing fixing device 201 is equipped with an active energy ray lamp, a motor and a belt for conveying sheets, a suction fan and the like. The stencil printing apparatus is configured such that the active energy ray curable ink is fixed onto a sheet within the active energy ray curing fixing device 201 and thus obtained printed/fixed sheet is delivered to a sheet delivery table 204 by means of the belt/suction conveyance. In FIG. 1, the sheet feeding portion 202 has substantially the same configuration as a sheet feeding portion 110 (shown in parentheses in FIG. 1) disposed on the sheet feeding side of the stencil printing apparatus main body 200 shown in FIG. 2, and a sheet feeding table 203 of the sheet feeding portion 202 is same as a sheet feeding table 51 (shown in parentheses in FIG. 1) of the sheet feeding portion 110. Similarly, the sheet delivery table 204 is same as a sheet delivery table 52 (shown in parentheses in FIG. 1).

The internal configuration of the active energy ray curing fixing device 201 is same as that of, for example, the UV irradiation device (2) serving as the ultraviolet irradiation device shown in FIG. 1 of the abovementioned Japanese Published Unexamined Patent Application No. 2006-281658. In this regard, the same configuration as the stencil printing control device (55) illustrated in FIG. 4 and the like of the abovementioned Japanese Published Unexamined Patent Application No. 2006-281658 is disposed in the stencil printing apparatus main body 200 shown in FIG. 2.

First, the entire configuration of the stencil printing apparatus main body 200 will be described with reference to FIG. 2.

In FIG. 2, reference numeral 50 indicates the apparatus main body constituting the framework of the stencil printing apparatus main body 200. As shown in the drawing, the section indicated by reference numeral 80 above the apparatus main body 50 is an original reading portion serving as an original reading device, the section indicated by reference numeral 1 therebelow is a plate-making portion serving as a digital heat-sensitive stencil plate-making device, the section indicated by reference numeral 20 provided to the left of the plate-making portion 1 is a print drum portion serving as a print drum device in which is disposed a print drum 21 having cylindrical porous plate cylinder on its outer peripheral portion, the section indicated by reference numeral 120 below the print drum 21 is a printing pressure portion serving as a printing pressure device, the section indicated by reference numeral 70 provided to the left of the print drum 21 is a plate delivery portion serving as a plate delivery device, the section indicated by reference numeral 110 below the plate-making portion 1 is a sheet feeding portion serving as a sheet feeding device, and the section indicated by reference numeral 130 provided to the left of the printing pressure device 120 and below the plate delivery device 70 is a sheet delivery portion serving as a sheet delivery device. Accordingly, in the stencil printing apparatus shown in FIG. 2, the apparatus main body 50 is equipped integrally with the plate-making portion 1.

The original reading portion 80 has a function of reading an image on a surface of an original 60 transported from an original mounting table, not shown, the plate-making portion 1 has a function of executing plate-making on a master 12 wrapped in the form of a roll and conveying it, the print drum portion 20 has a function of winding the engraved master 12 around the outer peripheral surface of the print drum portion 20 and supplying ink to the engraved master 12 on the print drum 21, the printing pressure portion 120 has a function of pressing sheets 62, i.e., media to be printed, against the print drum 21 by means of pressing means described hereinafter, and then forming a printed image on each of the sheets 62, the plate delivery portion 70 has a function of scraping off the used master 12 from the outer peripheral surface of the print drum 21 and delivering/plate-delivering it into a plate delivery box 74, the sheet feeding portion 110 has a function of feeding the sheet 62 placed on the sheet feeding table 51 to the space between the print drum portion 20 and the printing pressure portion 120, and the sheet delivery portion 130 has a function of delivering the sheet 62 printed by the print drum portion 20 and the printing pressure portion 120 to the sheet delivery table 52.

Figure 3:
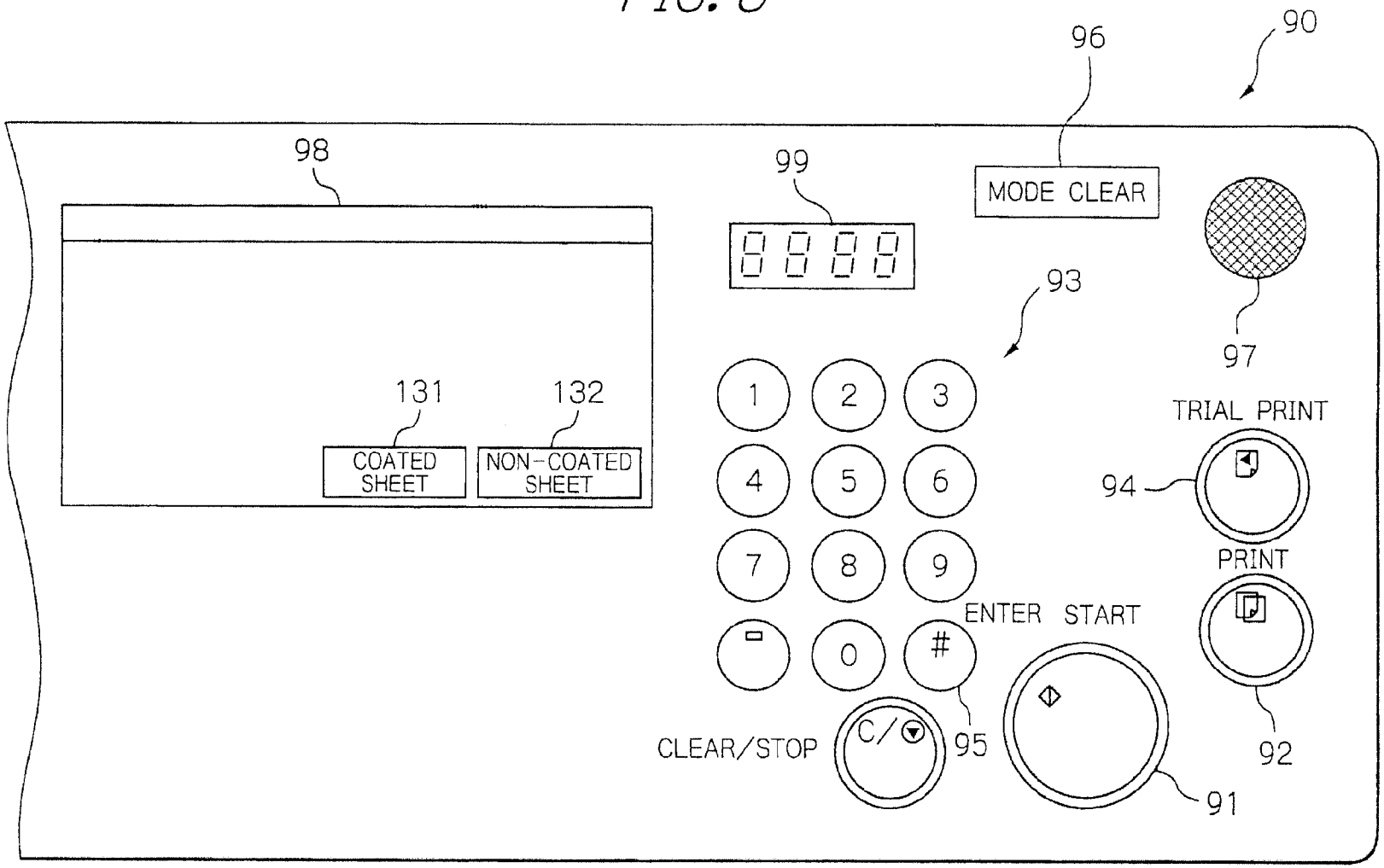
FIG. 3 is a plan view of an operation panel used in the stencil printing apparatus shown in FIG. 2.
Figure 4:
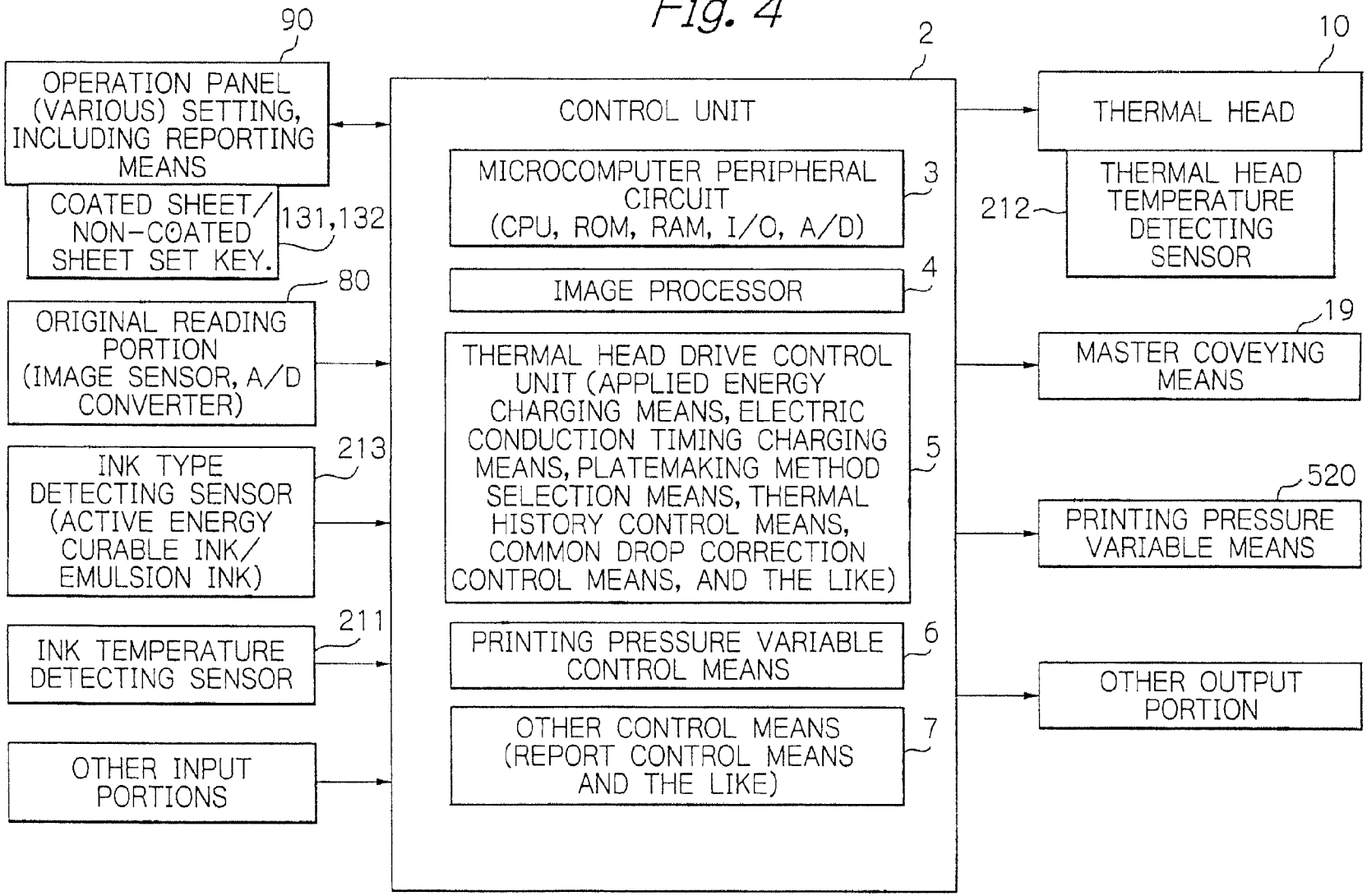
FIG. 4 is a block diagram showing the control configuration of a substantial part of the stencil printing apparatus shown in FIG. 1 and FIG. 2.

FIG. 2 through FIG. 4 are used to explain the basic operations of the stencil printing apparatus that are performed when the after-mentioned normal plate-making mode same as the conventional one is set. The configuration of the after-mentioned special plate-making mode and the differences with the operation performed when the normal plate-making mode is set will be described in detail after explaining the basic operations of the stencil printing apparatus.

First, a user places/sets the original 60 having an image to be printed on the original mounting table, not shown, that is disposed in the upper part of the original reading portion 80, and then presses a plate-making start key 91 of the operation panel 90 shown in FIG. 3. A plate-making start signal is generated by pressing this plate-making start key 91, triggering the execution of a plate delivery step first. Specifically, in this state, the used master 12 that was used in previous printing remains attached to the outer peripheral surface of the print drum 21. The print drum 21 is connected to print drum driving means (e.g., a main motor or the like, not shown) via a drive mechanism, not shown, and is rotated and driven by the print drum driving means.

The print drum 21 rotates in the opposite direction to the direction of the arrow A shown in the drawing, and once a rear end portion of the used master 12 attached to the outer peripheral surface of the print drum 21 approaches a pair of plate delivering/releasing rollers 71*a*, 71*b* of the plate delivery portion 70, the plate delivering/releasing roller 71*b* scoops up the rear end portion of the used master 12, while the pair of rollers 71*a*, 71*b* rotate. Then, a plate delivering/releasing conveying device gradually scrapes the used master 12 from the outer peripheral surface of the print drum 21, conveys it in the direction of the arrow Y1, and delivers it to the plate delivery box 74, the plate delivering/releasing conveying device being configured by a pair of plate delivery conveying belts 72*a*, 72*b*, which are stretched between a pair of plate delivery rollers 73*a*, 73*b* disposed to the left of a pair of plate delivering/releasing rollers 71*a*, 71*b*, and the pair of plate delivering/releasing roller 71*a*, 71*b*. In this manner, the plate delivery step is completed. At this moment, the print drum 21 continues to rotate in the counterclockwise direction. The delivered used master 12 is thereafter compressed in the plate delivery box 74 by a compression board 75.

In parallel with the plate delivery step, the original reading portion 80 is activated to carry out original reading. Specifically, the original 60 placed on the original mounting table is subjected to exposure reading while being conveyed in the directions of the arrow Y2 and the arrow Y3 (called "original conveyance direction Y2" hereinafter) as a separation roller 81, a pair of front original conveying rollers 82*a*, 82*b* and a pair of rear original conveying rollers 83*a*, 83*b* rotate. At this moment, when there are a number of originals 60, only the last original is conveyed by the action of a separation blade 84.

The upper rear original conveying roller 83*a* is rotated and driven by an original conveying motor (not shown) constituted by, for example, a stepping motor. The upper front original conveying roller 82*a* is rotated and driven by the original conveying motor via a timing belt (not shown) stretched between the upper conveying roller 83*a* and conveying roller 82*a*, and each of the rollers 82*b*, 83*b* is rotated accordingly. At this moment, with a command sent from sub-scanning feed speed control means of other control means 7 shown in FIG. 4, the original conveying motor is controlled so as to change a sub-scanning feed pitch of the original 60 to a predetermined sub-scanning feed pitch corresponding to the resolution (dots per inch) in the sub-scanning direction. Moreover, the configuration is not limited to this, and thus the original 60 may be read at a predetermined sub-scanning feed pitch, temporarily stored in an original memory serving as image storage means, and then processed.

The image reading of the original 60 is performed in the following manner. Specifically, reflected light obtained by illuminating the surface of the original 60 by means of a fluorescent lamp 86 is reflected on a mirror 87, while conveying the original 60 on a contact glass 85, and then the reflected light is made incident on an image sensor 89 composed of a CCD (charge coupled device or other photoelectric converter) via a lens 88. The original 60 subjected to image reading is delivered to the top of an original tray 80A.

In the original reading portion 80, a light path between the mirror 87 and the lens 88 has disposed thereon a configuration that has various functions to perform color separation required in multicolor overprinting, e.g., a configuration having the same function and configuration as the filter unit described in Japanese Published Unexamined Patent Application No. S64-18682, which is capable of switchably controlling a plurality of color filters.

In FIG. 2 and FIG. 4, the optical information (image data) of the original 60 is photoelectrically converted by the image sensor 89, and an analog electric signal of the converted information is input to an analog/digital (A/D) converter and thereby converted into a digital image signal. This digital image signal is subjected to image processing for stenciling by an image processor 4 within a control unit 2 shown in FIG. 4, and the image-processed digital image signal for binary black pixels and white pixels is input to a thermal head drive control unit 5 shown in FIG. 4. The thermal head drive control unit 5 is to mainly control each heat generator 9 of a thermal head 10 shown in FIG. 2 and FIG. 4 via a thermal head drive circuit (not shown), and performs a control operation in response to a command sent from a microcomputer peripheral circuit 3 shown in FIG. 4.

Next is described conventionally known normal plate-making executed by plate-making method selection means provided in the thermal head drive control unit 5. "Normal plate-making" means a known plate-making method in which perforated holes to be formed on a thermoplastic resin film of the master 12 by heating and driving the individual heat generators 9 of the thermal head 10 are formed in the same line in a main scanning direction of the thermal head 10 in response to a digital image signal. In the thermal head drive control unit 5, there are disposed first control means for executing special plate-making unique to the present embodiment, and second control means for controlling the individual heat generators 9 of the thermal head 10 to execute the normal plate-making, on the basis of a signal from the plate-making method selection means, the special plate-making being described hereinafter in detail.

Note that the optical information (image data) that is input to the A/D converter is read not only by the CCD but also by, for example, a contact image sensor (CIS). Moreover, the digital image data that is input to the thermal head control unit 5 within the control unit 2 may be a digital image signal transmitted from a computer such as a personal computer.

The digital image signal that is input to the thermal head control unit 5 within the control unit 2 is appropriately subjected to various known control operations performed by the means excluding applied energy changing means and electric conduction timing changing means for performing the abovementioned special plate-making, the various control operations including thermal history control performed by thermal history control means disposed in the control unit 2, and common drop correction control performed by common drop correction control means, and also subjected to various control operations performed by the abovementioned other control means 7 to generate a digital image data signal (simply abbreviated as "data signal" or "DATA signal" hereinafter), a clock signal (abbreviated as "CLK signal" hereinafter), a latch signal (abbreviated as "LATCH signal" hereinafter), an electric conduction signal (abbreviated as "strobe signal" or "STB signal" hereinafter) and the like as signals for driving the thermal head, and then these signals are transmitted to the thermal head 10 via the thermal head drive circuit (not shown).

On the other hand, in parallel with such original scanning and image reading operation, plate-making and plate-feeding steps are performed based on the digitalized image information (digital image signal). Specifically, the plate-making start key described above triggers rotation and driving of a master feeding motor 11 constituted by, for example, a stepping motor, whereby the master 12 is set in a feedable manner by means of a master supporting member, not shown, and the master 12 is drawn out of a master roller 12A formed around a core tube 12*a* in the form of a roll. At this moment, the master 12 is conveyed to the downstream side in the sub-scanning direction Y shown by the arrow Y in the drawing (called "master conveyance direction Y" hereinafter) as a platen roller 14 serving as master conveying means and a pair of tension rollers 15*a*, 15*b* rotate at a constant speed, the platen roller 14 being pressed against the thermal head 10 via the master 12.

At this moment, with the command sent from the sub-scanning feed speed control means of the abovementioned other control means 7 shown in FIG. 4, the master feeding motor 11 is controlled so as to change a sub-scanning feed pitch of the master 12 to a predetermined sub-scanning feed pitch corresponding to the resolution in the sub-scanning direction Y.

In response to the image data signal sent from the thermal head drive control unit 5 provided within the control unit 2, each of a number of small heat generators 9 arranged in a line in the main scanning direction of the thermal head 10 generates heat regioselectively on the master 12 to be conveyed, and thereby the film portion of the master 12 in contact with the heated heat generators 9 is subjected to heat melt perforation. In this manner, the master 12 is subjected to melt perforation regioselectively in response to the image information, and thereby the image information is written as a perforated pattern to the master 12.

The platen roller 14 is connected to the master feeding motor 11 via the timing belt and a rotation transmitting member (not shown), such as a gear, and rotated by the rotation of the master feeding motor 11. The master feeding motor 11 is constituted by, for example, a stepping motor. The rotary drive force of the master feeding motor 11 is transmitted to the pair of tension rollers 15*a*, 15*b* via the rotation transmitting member (not shown), such as a gear, and to a vertical pair of reverse rollers 17*a*, 17*b* via an electromagnetic clutch (not shown).

Note that besides the electromagnetic clutch, there is a device in which is disposed a stepping motor different from the master feeding motor 11 rotating the driving rollers of the reverse rollers 17*a*, 17*b*.

The leading end of the engraved master 12 to which the image information is written is fed toward the outer peripheral portion side of the print drum 21 by the pair of reverse rollers 17*a*, 17*b*, and the direction of movement of the engraved master 12 is changed to a downward direction by a plate-feeding guide board 18. Then, the master 12 is hanged directed to an opened master clamper 22 of the print drum 21, which is in a plate-feeding position as shown by chain double-dashed lines in FIG. 2. At this moment, the used master 12 is already removed from the print drum 21 in the plate delivery step.

Then, an opening/closing device, not shown, which is disposed in the apparatus main body 50 to open and close the master clamper 22, is activated so that the leading end of the engraved master 12 is clamped/held by the master clamper 22 at predetermined timing, and, consequently, the print drum 21 gradually winds the engraved master 12 on its outer peripheral surface while rotating in the direction of the arrow A shown in the diagram (clockwise direction). The rear end portion of the engraved master 12 is cut into a predetermined length by a cutter 13 once the plate-making is completed, and the plate-making and plate-feeding steps are finished once a single plate of engraved master 12 is wound completely around the outer peripheral surface of the print drum 21.

Thereafter, the leading end of the remaining cut master 12 on the upstream side is conveyed toward a nip portion between the pair of reverse rollers 17*a*, 17*b* by the rotations of the platen roller 14, pair of tension rollers 15*a*, 15*b* and pair of reverse rollers 17*a*, 17*b*. The leading end of the conveyed master 12 is detected by a master leading end detecting sensor, not shown. When the master leading end detecting sensor determines that the leading end of the master 12 has occupied the initial position, the platen roller 14, pair of tension rollers 15*a*, 15*b* and pair of reverse rollers 17*a*, 17*b* stop rotating and enter a plate-making standby state to prepare for the next plate-making. The position that is slightly shifted forward from the position held by the nip portion between the pair of reverse rollers 17*a*, 17*b*, for example, is previously set as the initial position of the master 12.

Note that the platen roller 14, pair of tension rollers 15*a*, 15*b*, pair of reverse rollers 17*a*, 17*b*, and master feeding motor 11 constitute the means for conveying the master 12, and this conveying means is generically called "master conveying means 19" shown in FIG. 4.

Next, a printing step starts. First, the top single sheet out of the sheets 62 placed on the sheet feeding table 51 is drawn out by a sheet feeding roller 111, separated one by one by a pair of separation rollers 112*a*, 112*b* operating in cooperation with each other, fed toward a pair of resist rollers 113*a*, 113*b* in the direction of the arrow Y4 (called "sheet conveyance direction Y4" hereinafter), and fed to the space between the print drum 21 and a press roller 23 in the printing pressure portion 120 at predetermined timing in synchronization with the rotation of the print drum 21, by the pair of resist rollers 113*a*, 113*b*. This press roller 23 is configured so as to be separable with respect to the outer peripheral surface of the print drum 21 by means of known press roller displacement means, not shown, and functions as the pressing means for pressing the fed sheet 62 against the print drum 21 whose outer peripheral surface is wrapped with the engraved master 12, and then forming a printed image on the sheet 62. When the fed sheet 62 is inserted between the print drum 21 and the press roller 23, the press roller 23 that is separated below the outer peripheral surface of the print drum 21 oscillates/rises and is thereby pressed against the engraved master 12 wound around the outer peripheral surface of the print drum 21. Accordingly, the engraved master 12 is adhered to the outer peripheral surface of the print drum 21 by the adhesive force of the viscous ink bleeding from the porous portion of the print drum 21, and at the same time the ink bleeds from the perforated pattern portion of the engraved master 12 and is transferred to the surface of the sheet 62, whereby the printed image is formed.

At this time, on the inner periphery of the print drum 21, the ink is supplied from an ink supply tube 24 serving as a spindle 24 to an ink pool 27 formed between an ink roller 25 and a doctor roller 26, and the ink is supplied to the inner periphery side of the print drum 21 by the ink roller 25 that contacts with the inner peripheral surface of the print drum 21 while rotating in the same direction as the rotation direction of the print drum 21 and in synchronization with the rotational speed of the print drum 21.

Note that the ink supply tube 24, ink roller 25, and doctor roller 26 constitute ink supply means for supplying the ink to the engraved master 12 on the print drum 21. W/O emulsion ink, for example, is preferably used as the ink used when the conventional normal plate-making mode is set and when printing is performed on a high-quality sheet or other non-coated sheet. As the pressing means, not only the press roller 23 but also an impression cylinder having the same diameter as the print drum (plate cylinder) 21 can be used, and the present invention can be, of course, applied to a stencil printing apparatus with such impression cylinder system.

The sheet 62 on which the printed image is formed in the printing pressure portion 120 is peeled off from the print drum 21 by a delivery sheet removing nail 114 in the sheet delivery portion 130, suctioned by a suction fan 118, and stuck onto a porous conveying belt 117 stretched between an attraction sheet delivery inlet roller 115 and an attraction sheet delivery outlet roller 116. Then, the sheet 62 is conveyed toward the sheet delivery table 52 as shown by the arrow Y5 as the conveying belt 117 rotates in the counterclockwise direction, and delivered and stacked on the sheet delivery table 52 sequentially. So-called plate-mounting printing is ended in this manner. Note that the print speed when performing the plate-mounting printing is set as low as, for example, 16 through 20 sheets/min.

Upon completion of the plate-mounting printing, the press roller 23 separates from the print drum 21, and the print drum 21 returns to the initial position (home position) so that the master clamper 22 is positioned substantially directly above the print drum 21 in FIG. 2, and enters a print standby state.

Next, a print speed set key, not shown, which is disposed on the operation panel 90 shown in FIG. 3, is pressed to set a desired print speed value. Around the time when a desired print speed value is set, a numeric keypad 93 of the operation panel 90 is used to set the number of print pages, and then a print start key 92 is pressed, whereby the steps of feeding sheets, printing, and delivering the sheets are repeatedly performed on the set number of print pages at the set print speed in the same manner as the step of plate-mounting printing, and all steps of the stencil printing are completed.

Hereinafter, the special plate-making mode unique to the present embodiment and the configurations of the substantial parts associated with this mode, i.e., the plate-making portion 1, the operation panel 90, the print drum portion 20, printing pressure variable means and the like, will be described in detail.

Examples of the master 12 that is being used in the stencil printing apparatus shown in FIG. 1 and FIG. 2 include a laminated structure obtained by sticking together a thermoplastic resin film and a porous support body configured by Japanese paper fiber or synthetic fiber or by mixing Japanese fiber and synthetic fiber together. Polyethylene terephthalates (PET), for example, are used as the thermoplastic resin film. Note that all known masters can be used as the master 12. Specifically, as the master 12 used in a stencil printing apparatus, the one having a thickness in the range of 20 through 60 μm is used, and, as the thermoplastic resin film of the master 12, the one having a thickness in the range of 1.0 through 4.0 μm is used.

As the master 12, not only the one described above but also the one obtained by thinning the thickness of the porous support body of the master 12 may be used. For example, the following masters can be used: the synthetic fiber base master (2) described in Japanese Published Unexamined Patent Application No. H11-77949; a master having the thermoplastic resin film, at least one layer of porous resin membrane, and a porous support body as described in Japanese Published Unexamined Patent Application No. H10-147075, i.e., a master in which a porous resin membrane composed of resin is provided on one surface of the thermoplastic resin film and a porous fiber membrane composed of a fibrous substance is stacked on the surface of the porous resin membrane; or a master substantially composed only of a thermoplastic resin film.

As shown in FIG. 2, an environmental temperature sensor 210 serving as environmental temperature detection means for detecting the environmental temperature is disposed in the vicinity above the plate delivery portion 70 within the apparatus main body 50. Within the print drum 21, there is disposed an ink temperature sensor 211 that serves as ink temperature detection means disposed in a section forming the ink pool 27 of the ink supply means and for detecting the temperature of the ink. The ink temperature sensor 211 is configured as an ink temperature detecting portion in FIG. 4.

Within the plate-making portion 1, there is disposed a thermal head temperature detecting sensor 212 serving as thermal head temperature detection means for detecting the temperature of the thermal head 10. The place for disposing the thermal head temperature detecting sensor 212 is preferably the same section as the one shown in FIG. 4 of Japanese Published Unexamined Patent Application No. 2006-82358, i.e., the surface part of each heat generator 9, or a section near the surface part in the center of the heat generator 9 surrounded by, for example, electrodes. However, because it is nearly impossible to detect the temperature of the thermal head in this section under the technologies at this moment, in this embodiment the temperature of the thermal head 10 main body is detected on a thermal head substrate which is a circuit board installed in the thermal head 10. The thermal head temperature detecting sensor 212 may be provided not only in the abovementioned section but also within an aluminum radiating support body, which is also called an aluminum heat radiating support board configuring the thermal head 10.

Comparatively small and inexpensive thermistors with desired sensitivity and reliability are preferably used as the environmental temperature sensor 210, ink temperature sensor 211, and thermal heat temperature detecting sensor 212. If such advantages are not desired, other temperature detection may be used.

The thermal head 10 functions as plate-making means for regioselectively subject the master 12 to heat melt perforation to perform plate-making, by regioselectively heating a number of heat generators on the basis of a thermal head drive signal including the digital image data signal that is processed and sent by the thermal head drive control unit 5 of the control unit 2 via the above-described image sensor 89, A/D converter, not shown, image processor 4 and the like, or via the image processor after passing through a personal computer controller, not shown, an interface device, or a data expansion portion that are used for receiving a digital image signal from a personal computer or the like, not shown. The thermal head 10 is configured to be separable with respect to the platen roller 14 with the master 12 therebetween by known attaching/separating means, not shown.

The plate-making portion 1 configures a plate-making unit that is made detachable with respect to the apparatus main body 50 by using known attaching/detaching means.

In this stencil printing apparatus, generally, the one called "flat type thermal head" among thin-film thermal heads is used as the thermal head 10, but thermal heads of all known forms and types that have a plurality of (a number of) heat generators arranged in the main scanning direction are included. Specifically, as the thermal head 10, the flat type thermal head, an edge face type thermal head, real edge type thermal head, or a corner edge type thermal head may be used.

Moreover, normally the one having a rectangular shape as viewed planarly is used as the heat generators 9 of the thermal head 10, but the one of heat concentration type may be used.

As described above, the plate-making portion 1 is a device in which a number of heat generators 9 arranged in the main scanning direction of the thermal head 10 are brought into contact with the film of the master 12 to move the master 12 in the sub-scanning direction perpendicular to the main scanning direction at a predetermined sub-scanning feed pitch, and then the film of the master 12 is subjected to melt perforation by regioselectively heating the individual heat generators 9 in response to image data (image signal) to form, on the master 12, a perforated/plate-making image (perforated pattern) formed with dots corresponding to the image signal.

In the plate-making portion 1 of the present embodiment, the resolution in the sub-scanning direction Y obtained when moving the master 12 relatively in the sub-scanning direction Y is set previously so that it becomes equal to the resolution of the thermal head 10. In the feeding operation of conveying the master 12 in the sub-scanning direction Y, the master 12 may be moved not only intermittently but also continuously at the predetermined feed pitch of the example described above. Not only the original reading portion 80, but also a scanner moving system may be adopted in which the original 60 is placed/fixed on the contact glass to read the original while moving a scanning optical system having a fluorescent lamp, mirror and the like by means of a drive motor. In this case, the drive motor may be controlled so as to change the movement speed of the scanning optical system to a predetermined feed pitch corresponding to the resolution in the sub-scanning direction Y.

The operation panel 90 is disposed in one side portion above the original reading portion 80. In the operation panel 90, the plate-making start key 91, the print start key 92, the numeric keypad 93, a trial print key 94, an enter key 95, a mode clear key 96, a touch panel 98, an indicator 99, and the like are disposed, as shown in FIG. 3. Moreover, in the operation panel 90, functions serving as reporting means and coated sheet/non-coated sheet setting means are disposed as shown in FIG. 4. These functions will be described hereinafter.

The plate-making start key 91 has a function serving as operation starting means for starting a series of steps (operations) ranging from reading an image on an original, to plate delivery, plate making, plate feeding, sheet feeding, plate-mounting printing, and sheet delivery. The numeric keypad 93 has a function of inputting/setting the number of print pages and the like. The print start key 92 has a function of starting a printing operation to print the number of print pages input/set using the numeric keypad 93. The trial print key 94 has a function of starting a trial printing operation. The enter key 95 has a function of confirming/setting numeric numbers and the like when performing various settings. The mode clear key 96 has a function of deleting/clearing various mode settings. These keys are pressed when demonstrating the respective functions.

The touch panel 98 is configured so as to be driven by an LCD (liquid crystal display) drive circuit including a touch panel drive circuit, not shown, and so that various modes and various selection setting means (the coated sheet/non-coated sheet setting means described above) that are displayed using a known touch panel method are highlighted with black and white and selected/set.

The display means or reporting means disposed on the touch panel 98 and constituted by an LCD screen is used for, when the ink to be used does not match the coated sheet or non-coated sheet, displaying or reporting to that effect. Specifically, the display means or reporting means displays/reports by showing an indication, such as "printing cannot be performed in this combination," on the touch panel 98.

The coated sheet/non-coated sheet setting means functions as coated sheet/non-coated sheet plate-making/print mode selection setting means capable of setting the plate-making/print mode for executing plate-making and printing making operations corresponding to coated sheet and non-coated sheet used as the sheets, and, specifically, configured by a coated sheet set key 131 and a non-coated sheet set key 132 that are provided on the touch panel 98.

The form of the reporting means is not limited to the display on the touch panel 98, and thus, for example, LCDs or LEDs may be simply displayed, or sounds or a blowing beep from a buzzer 97 disposed on the operation panel 90 or the like may be used, or codes may be displayed using seven segments of LEDs, or alternatively a combination of these may be appropriately used as the reporting means. The coated sheet/non-coated sheet setting means may not only be disposed on the touch panel 98, but also provided in the form of, for example, a special key or a plurality of select set keys for setting while performing hierarchical display using LCDs.

Ink type detection means is, in a limited sense, for detecting which of the active energy curable ink and the emulsion ink is used, and, in a broad sense, for detecting all types of inks used in the stencil printing apparatus. The narrowly defined ink type detection means will be described hereinafter.

The print drum 21 configures a drum unit obtained by integrally unitizing an ink container and an ink pump, which are not shown, and is made detachable with respect to the apparatus main body 50 through a simple operation of attaching/detaching means. Also, an active energy ray curable ink print drum unit that has an active energy ray curable ink print drum filled/attached with the active energy ray curable ink and an emulsion ink print drum unit that has an emulsion ink print drum filled/attached with the emulsion ink as non-active energy ray curable ink are set separately and made detachable with respect to the apparatus main body 50 by means of the attaching/detaching means. As a specific example of the attaching/detaching means or an attaching/detaching mechanism (not shown) for making the active energy ray curable ink print drum unit and the emulsion ink print drum unit detachable with respect to the apparatus main body 50, the one same as the plate cylinder supporting device shown in, for example, FIG. 1 to FIG. 4 of Unexamined Utility Model Application Publication No. S61-85462 is adopted. Moreover, the one same as the one configured by the holding means (36), grip frame (50), front frame (51), rear frame (52) and the like that are shown in, for example, FIG. 2, FIG. 3 and the like and described in the paragraph "0021" and the like of Japanese Published Unexamined Patent Application No. H5-229243 may be used.

An ink type detecting sensor 213 serving as the ink type detection means shown only in FIG. 4, which detects the type of ink by detecting which of the active energy ray curable ink print drum unit and the emulsion ink print drum unit is installed in the attaching/detaching means, is disposed in the apparatus main body 50 in the vicinity of the attaching/detaching means. As a specific example of the ink type detecting sensor 213, there is adopted the one configured such that the reporting means disposed within the abovementioned other control means 7 electrically detects and determines the difference between the inks by means of the microcomputer peripheral circuit 3 on the basis of the combinations of connections between an electrical connector (male, for example) disposed on the print drum unit side and an electrical connector (female, for example) disposed on the apparatus main body 50 side. This is same as the kind discriminating sensor (51) shown in FIG. 4 of abovementioned Japanese Published Unexamined Patent Application No. 2006-281658.

The ink type detection means for detecting which of the active energy curable ink and the emulsion ink is used may not only be the ink type detecting sensor 213 but also the one for detecting based on the following principles. Specifically, the cohesive force, tack value and the like of the active energy curable ink are higher than those of the emulsion ink regardless of the difference in ink temperature thereof obtained when detecting the active energy ray curable ink is detected. Therefore, the ink viscosity detecting device described in Japanese Published Unexamined Patent Application No. H10-44577 proposed by the applicants of the present invention may be used to detect the ink viscosity and detect which of the active energy ray curable ink and the emulsion ink is used.

This ink type detection means is an ink viscosity detecting device that has: an ink viscosity detecting roller (not shown) that is disposed in contact with, via an ink layer, an ink applied surface on the downstream side in the direction of rotation of an ink roller 25 in a section in the proximity of the ink roller 25 supplying ink to the inner peripheral surface of the print drum 21 and in the proximity of the doctor roller 26 disposed in proximity to the ink roller 25; roller driving means (not shown) for rotating the ink viscosity detecting roller with a predetermined torque; a constant-current power supply (not shown) that supplies constant current for rotating and driving the roller driving means with a predetermined torque; and roller speed detection means for detecting the rotational speed of the ink viscosity detecting roller, wherein the ink viscosity is detected by detecting a change in the rotational speed of the ink viscosity detecting roller. The roller speed detection means has an encoder that is disposed in the ink viscosity detecting roller, and a pulse generator that is disposed in proximity to the encoder and generates pulses in cooperation with the encoder, wherein the ink viscosity is detected based on a change in the pulses generated by the pulse generator, and it is detected which of the active energy curable ink and the emulsion ink is used. When the ink viscosity is relatively high, it is determined that the active energy curable ink is used.

Next is described printing pressure variable means for changing the printing pressure when the sheet 62 serving as a medium to be printed is pressed against the print drum 21. As the printing pressure variable means of the present embodiment, printing pressure variable means for changing the printing pressure serving as a pressing force of the press roller 23 against the print drum 21 is used, and the printing pressure variable means (20) same as the one shown in FIG. 3 of Japanese Published Unexamined Patent Application No. 2004-155170 is adopted.

Specifically, as shown in FIG. 3 of the above-mentioned application, the printing pressure variable means (20) is known and configured mainly by: a printing pressure control motor (14) which is fixedly attached to the apparatus main body (50) via an immobile member, not shown, an output axis of which is attached with a worm (15), and which is capable of forward and reverse rotation; a movable axis (7) which is supported so as to be able to advance and retract freely with respect to only the longitudinal direction of a sheet conveyance direction (Y4) via a groove (not shown) with which other end of a spring (6) is latched and which is formed in the apparatus main body frame (50), and an inner peripheral portion of which is formed with a male screw; a rotatable rotational axis (10) an outer peripheral portion of which is formed with a female screw that is screwed with the male screw of the movable axis (7); a worm wheel (11) that is fixedly attached to the rotational axis (10) and is engaged with the worm (15) at all times; an encoder (12) fixedly attached to an end of the rotational axis (10) and for detecting the revolutions of the worm wheel (11); a spring length detecting sensor (13) that is attached to a position in the vicinity of the encoder (12) in the apparatus main body frame (50) via the immobile member, not shown, and sandwiches the encoder (12) with a predetermined interval; a light shielding board (8) that is formed such as to protrude outward from the outer peripheral portion of the movable axis (7); and a printing pressure home position sensor (9) that is attached to a position in the vicinity of the light shielding board (8) of the apparatus main body frame (50) via the immobile member, not shown, sandwiches the light shielding board (8) with a predetermined interval, and detects the home position of the encoder (12) (position indicating a printing pressure standard state). The printing pressure control motor (14) functions as a drive source for changing the printing pressure of a press roller (103) against a print drum (101) by changing the tensile length of the spring (6), i.e., by changing the tensile force of the spring (6).

The printing pressure variable means of the present embodiment is applied with reference numeral 520 by adding 500 to reference numeral (20) of the printing pressure variable means shown in FIG. 3 of the abovementioned application, and thus is substantially the same as the printing pressure variable means (20) (see the printing pressure variable means 520 shown in FIG. 4).

Figure 5A:
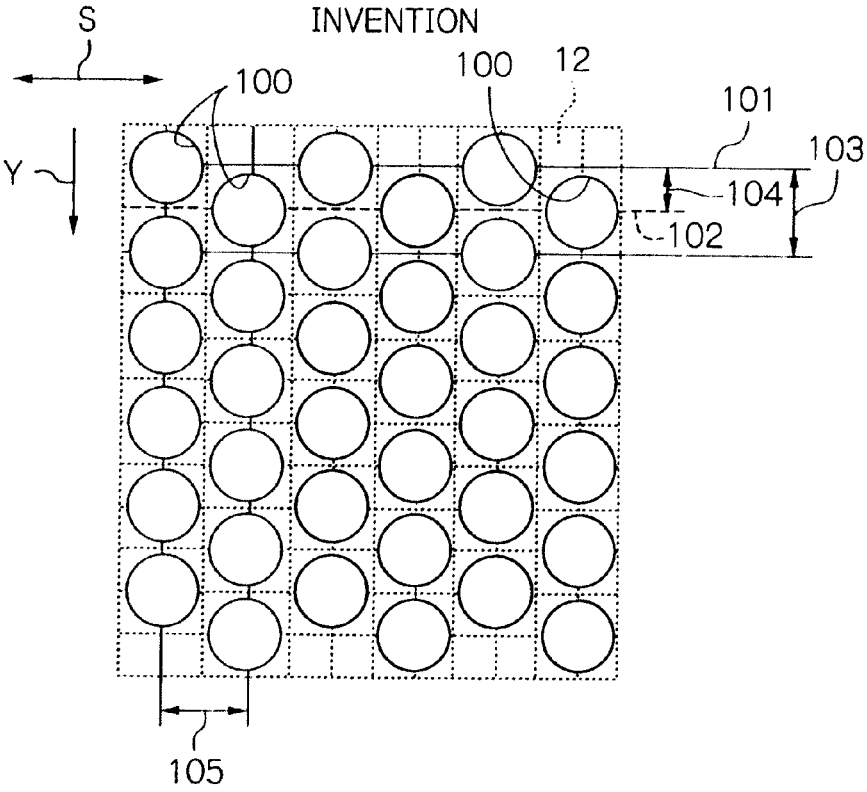
FIG. 5A is a plan view for explaining a perforated state of an engraved master obtained in a special plate-making mode of the present embodiment (present invention)
Figure 5B:
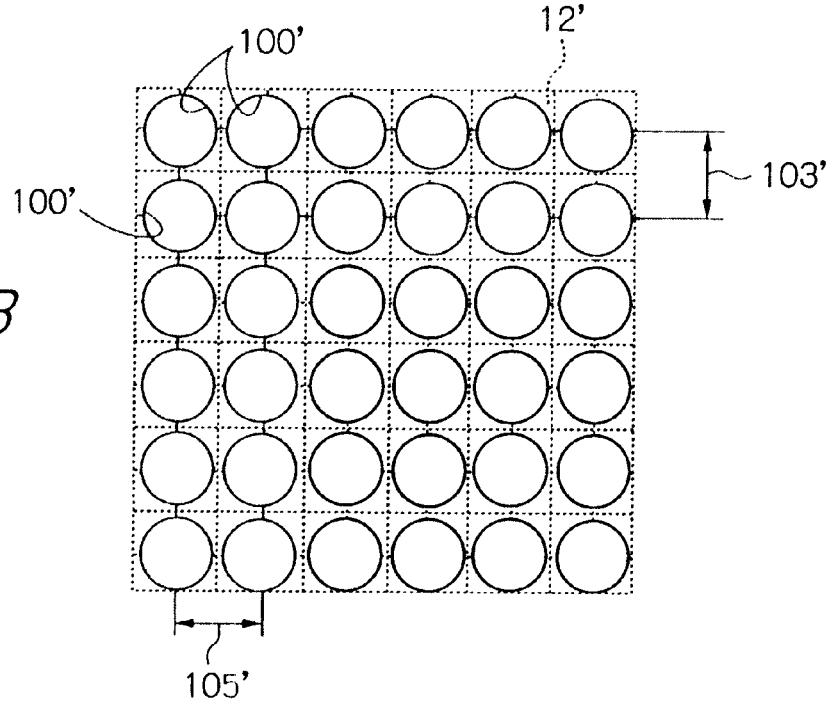
FIG. 5B is a plan view for explaining a perforated state of an engraved master obtained in a conventional normal plate-making mode.
Figure 6:
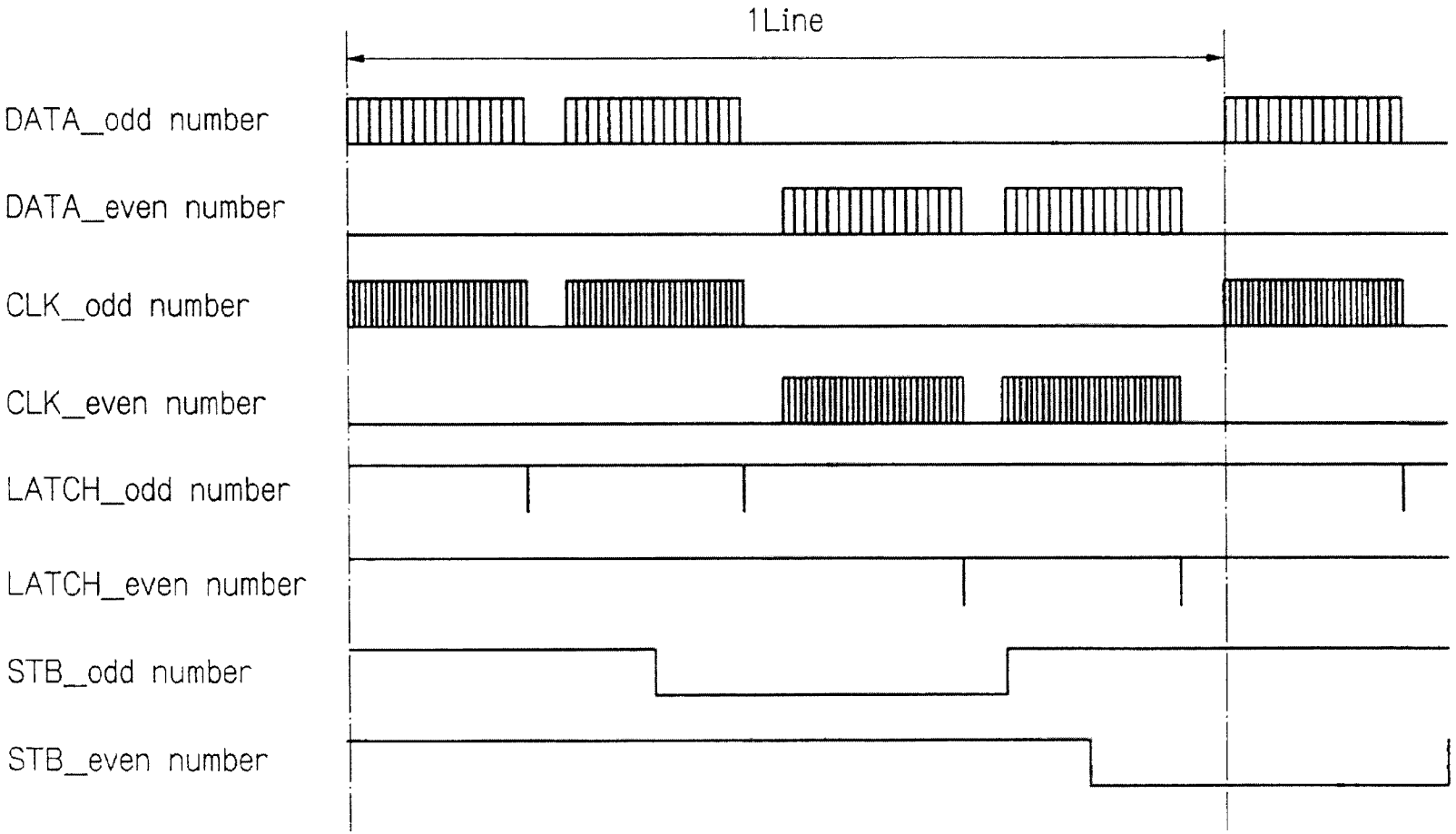
FIG. 6 is a timing chart of each signal transmitted to a thermal head of the present embodiment.

The printing pressure variable means 520 is not limited to the above printing pressure variable means, and thus pressing force variable means (130) shown in FIG. 5 and FIG. 6 of Japanese Published Unexamined Patent Application No. 2003-39802 may be used, including when using an impression cylinder, for example.

The periphery of the control configuration for controlling mainly the plate-making portion 1, the operation panel 90, and the printing pressure variable means 520 of the stencil printing apparatus will be described with reference to FIG. 4. As shown in this drawing, the microcomputer peripheral circuit 3 within the control unit 2 is configured by microcomputers and the like such as a CPU, ROM, RAM, internal timer, I/O port, A/D converter, and various counters.

The CPU of the microcomputer peripheral circuit 3 has computation and control functions to control the image processor 4, thermal head drive control unit 5, printing pressure variable control means 6 and other control means 7 as a whole. An operation program, related data and the like for exercising the above-mentioned functions of the microcomputer peripheral circuit 3 are stored beforehand in the ROM of the microcomputer peripheral circuit 3. The RAM of the microcomputer peripheral circuit 3 temporarily stores data sent from various sensors and the results of computation performed by the microcomputer peripheral circuit 3.

The control unit 2 is provided with: an environmental temperature detecting portion capable of detecting the environmental temperature from a detection data signal (environmental temperature detection information) related to the environmental temperature output from the environmental temperature sensor 210; a thermal head temperature detecting portion capable of detecting the thermal head temperature from a detection data signal (thermal head temperature detection information) related to the thermal head temperature output from the thermal head temperature detecting sensor 212; and an ink temperature detecting portion capable of detecting the ink temperature from a detection data signal (ink temperature detection information) related to the ink temperature output from the ink temperature sensor 211.

The various detecting portions, i.e., the environmental temperature detecting portion, the thermal head temperature detecting portion and the ink temperature detecting portion, are configured so as to be able to detect various temperatures using the A/D converter and the like.

The electric conduction timing changing means and the plate-making method selection means of the microcomputer peripheral circuit 3 and the thermal head drive control unit 5 function as the first control means for controlling the individual heat generators 9 of the thermal head 10 such that perforated holes to be formed on the film by heating and driving odd bits corresponding to the odd-numbered heat generators 9 of the thermal head 10 and even bits corresponding to the even-numbered heat generators 9 are formed in different lines running in the main scanning direction in response to data signals of black pixels that are transmitted sequentially from the image processor 4, and such that the perforated holes to be formed on the film by heating and driving adjacent odd bits and even bits are not arranged adjacent to each other in the same line in the main scanning direction.

The data signals of black pixels or white pixels that are transmitted sequentially from the image processor 4 are allocated beforehand one by one to each of the heat generators 9 arranged sequentially in a line from one end of the main scanning direction of the thermal head 10 toward the other end of the same, hence the odd bits (odd-numbered heat generators 9) and the even bits (even-numbered heat generators 9) of the thermal head 10 are unambiguously defined so as to correspond to the data signals of the black pixels or white pixels.

The electric conduction timing changing means of the thermal head drive control unit 5 has a function of changing the electric conduction timing for the odd bits and the even bits of the thermal head 10.

The applied energy changing means of the thermal head drive control unit 5 has a function of changing the applied energies applied to the odd bits and the even bits of the thermal head 10.

The printing pressure variable control means 6 has a function of controlling the printing pressure control motor (14) of the printing pressure variable means 520 so as to set a printing pressure value corresponding to the coated sheet or non-coated sheet when printing is performed on the coated sheet or non-coated sheet.

Report control means disposed within the abovementioned other control means 7 has a function of, when the ink to be used (active energy ray curable ink/emulsion ink) does not match the coated sheet or non-coated sheet, controlling the LCD screen (display/reporting means) of the touch panel 98 and causing it to display/report to that effect, on the basis of a signal sent from the ink type detecting sensor 213.

It should be noted that the control configuration shown in FIG. 4 is merely an example of the present embodiment, and thus an integrated control configuration in which, for example, the microcomputer peripheral circuit 3 is embedded in the thermal head drive control unit 5 may be used.

Next, a perforated pattern obtained by performing melt perforation on the film of the master 12 by means of the thermal head 10 of the stencil printing apparatus of the present embodiment will be described with reference to FIGS. 5A and 5B.

FIG. 5A shows a schematic perforated pattern formed on the film of the master 12 when the special plate-making mode is executed by the first control means of the present embodiment (present invention). FIG. 5B is a schematic perforated pattern formed on the film of a master 12' when the normal plate-making mode is executed by the second control means of the present embodiment (comparative example). Both drawings extract the perforated states generated in the solid parts. Note that, in FIG. 5, FIG. 12 and the like, in order to distinguish the master 12' obtained by executing the normal plate-making mode from the master 12 obtained by executing the special plate-making mode, reference numeral 12' is used only when explaining these masters with reference to the abovementioned drawings.

Both of the perforated patterns are subjected to perforation/plate-making under the conditions of the thermal head 10 of the following specification, sub-scanning feed resolution of the plate-making portion 1 and the printing energy (perforation energy). When executing both modes, the master of the same specification is used, and the temperature and humidity that are the environmental conditions are also identical.

Thermal head specification: 600 dpi (the think-film and flat heat generator is in a rectangular shape)

Sub-scanning feed resolution (feed pitch): 600 dpi

Image pattern (perforated pattern): Solid

In FIG. 5A, reference numeral 100 indicates perforated sections obtained by melt-perforating the film of the master 12 by means of the thermal head 10. In this drawing, reference numeral 101 indicates lines that are melt-perforated by the odd bits of heat generators 9 of the thermal heat 10, and reference numeral 102 indicates lines that are melt-perforated by the even bits of heat generators 9 of the thermal head 10. Reference numeral 105 indicates a resolution pitch in the main scanning direction S of the thermal head 10 to be used. Reference numeral 103 indicates a pitch in the sub-scanning direction Y of the line 101 that is melt-perforated by the odd bits of heat generators 9 of the thermal head 10, and reference numeral 104 indicates a pitch difference in the sub-scanning direction Y that is obtained when melt perforation is performed by the odd bits and even bits of heat generators 9 of the thermal head 10.

The characteristic of the perforated state shown in FIG. 5A is that it appears to be, in a large view, a tortoiseshell due to the orderly arrangement of the perforated patterns, and such a characteristic is unique to the case where the special plate-making mode is executed. In FIG. 5A, in the melt-perforated state obtained by the heat generators 9 of the thermal head 10, the pitch difference 104 in the sub-scanning direction Y (master conveyance direction Y) between an odd and an even bit of the heat generators 9 is ½ of the resolution pitch 105 in the main scanning direction S of the thermal head 10.

Next, a conventional perforated state will be described as a comparative example shown in FIG. 5B. In FIG. 5B, reference numerals 100', 103' and 105' correspond to reference numerals 100, 103 and 105 shown in FIG. 5A, respectively. In FIGS. 5A and 5B, each one of the rectangular frames drawn by the dashed lines shows one pixel (same hereinafter).

In the perforated states shown in FIG. 5A and FIG. 5B, a separating portion is formed between the perforated holes 100 and between the perforated holes 100' so as to obtain perforated holes independently. The characteristic of the perforated state shown in FIG. 5A is that the remaining width size between adjacent perforated holes 100 on the film is wider than the thickness of the thermoplastic resin film. Incidentally, when the thickness of the thermoplastic resin of the used master 12 is 1.8 μm, the remaining width size on the thermoplastic resin film that is obtained upon melt perforation is wider than 1.8 μm at the narrowest section between adjacent perforated holes in the sub-scanning direction Y.

Next, a driving method for performing melt perforation using each heat generator 9 of the thermal head 10 will be described with reference to FIG. 6. This drawing schematically shows the electric conduction timing of the odd bits and the even bits of heat generators 9 of the thermal head 10. Basically, electric conduction is performed by the electric conduction timing changing means of the thermal head drive control unit 5 at different timings for the odd bits and even bits. As described above, when the thermal head 10 is driven, four signals are basically required: a DATA signal when causing the thermal head to perform printing, a CLK signal for transferring the DATA signal to a driver IC provided within the thermal head 10, a LATCH signal for latching the DATA signal transferred to the driver IC, and an STB signal for electrically conducting the thermal head 10.

In order to achieve clarification in FIG. 6, each of these signals is classified into "odd" for odd bits and "even" for even bits. The characteristic of the drawing is that the electric conduction timing is different between the odd bits and even bits. Actually, it is often the case that the inside of the thermal head 10 is divided into several blocks and then heated and driven. In this case, it is considered that control is performed for each odd bit and each even bit regardless of that each block is controlled, although the thermal head 10 is divided into blocks. Moreover, control may be performed for each odd bit and each even bit within each block, and the driver IC itself within the thermal head 10 may be divided into odd bits and even bits to perform control. The important thing in the present invention is that the odd bits and even bits are not arranged in a line in the main scanning direction S. In the perforated state in the divided driving of the thermal head 10, of course the pitch difference 104 in the sub-scanning direction Y (master conveyance direction Y) between an odd and an even bit of the heat generators 9 is ½ of the resolution pitch 105 in the main scanning direction S of the thermal head 10.

Figure 7:
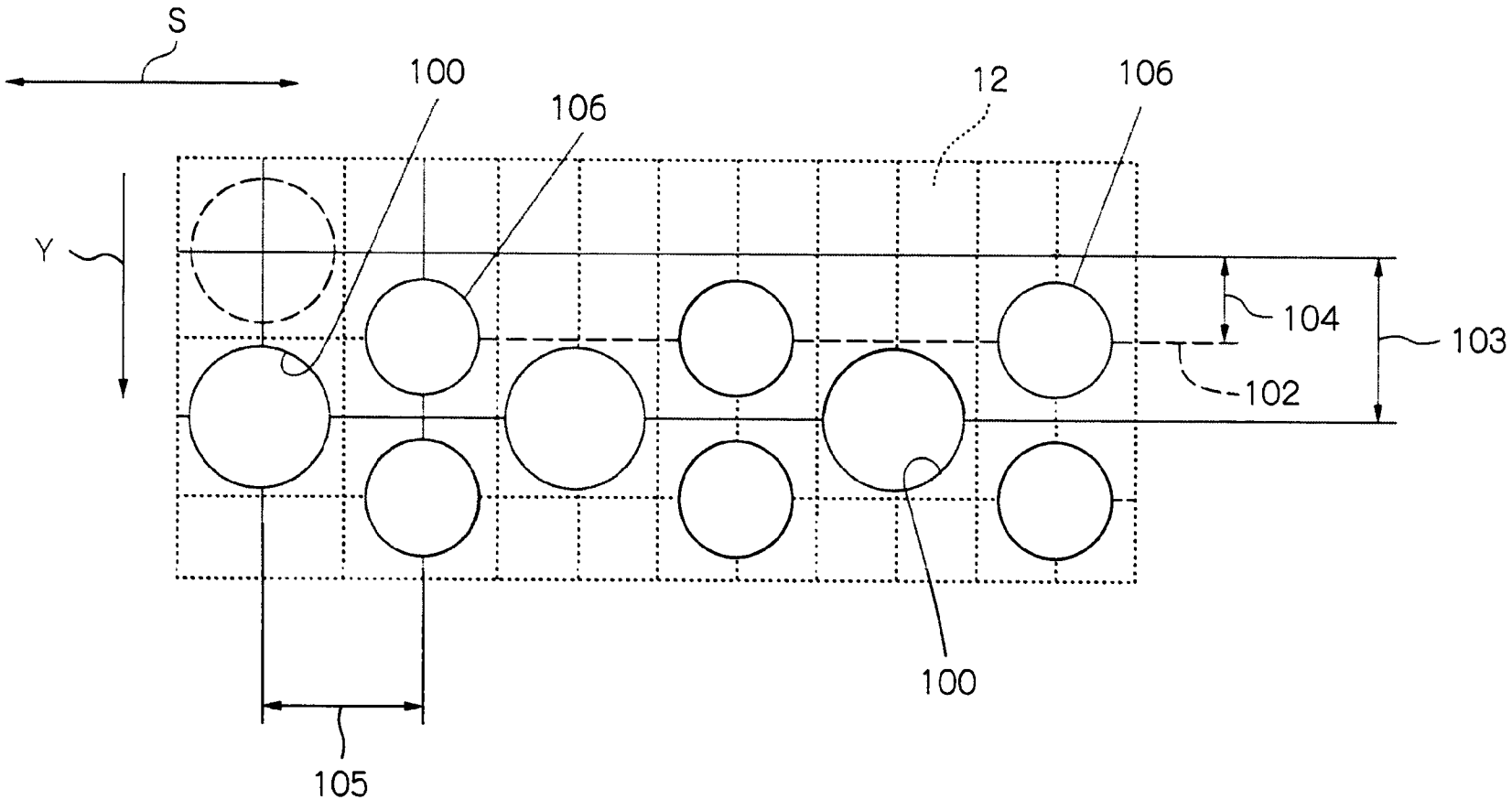
FIG. 7 is a plan view for explaining a perforated state of an engraved master obtained when an electric conduction energy is changed, the perforated state being associated with a perforated pattern that can be formed in the special plate-making mode of the present embodiment.

A perforated pattern that can be formed in the present embodiment will be described with reference to FIG. 7. This drawing shows the driving method for causing each heat generator 9 of the thermal head 10 to perform melt perforation, wherein the electric conduction energy is changed when driving with regard to odd bits and even bits of heat generators 9, i.e., the applied energy changing means of the thermal head drive control unit 5 in FIG. 4 is used to make the electric conduction energy smaller than that of the odd bits, the electric conduction energy being an applied energy to be applied to the even bits of heat generators 9 (e.g., electric conduction pulse width), so that different perforated states are obtained. In other words, in this manner, the size (diameter) of a perforated hole 106 obtained by an even bit is formed to be smaller than the size (diameter) of the perforated hole 100 obtained by an odd bit. By obtaining such perforated states, the effect of obtaining smoothly printed thin lines is achieved.

It should be noted that the applied energy (perforating energy) may be adjusted/changed by changing the value of current flowing in the individual heat generators 9 of the thermal head 10 or the value of voltage applied to the heat generator 9 in response to an image signal, as described in Japanese Patent Application No. 2756219. However, in the present embodiment, generally the applied energy is changed/adjusted by changing the width of an electric conduction pulse supplied to each heat generator 9 of the thermal head 10 via the thermal head drive circuit.

Figure 9:
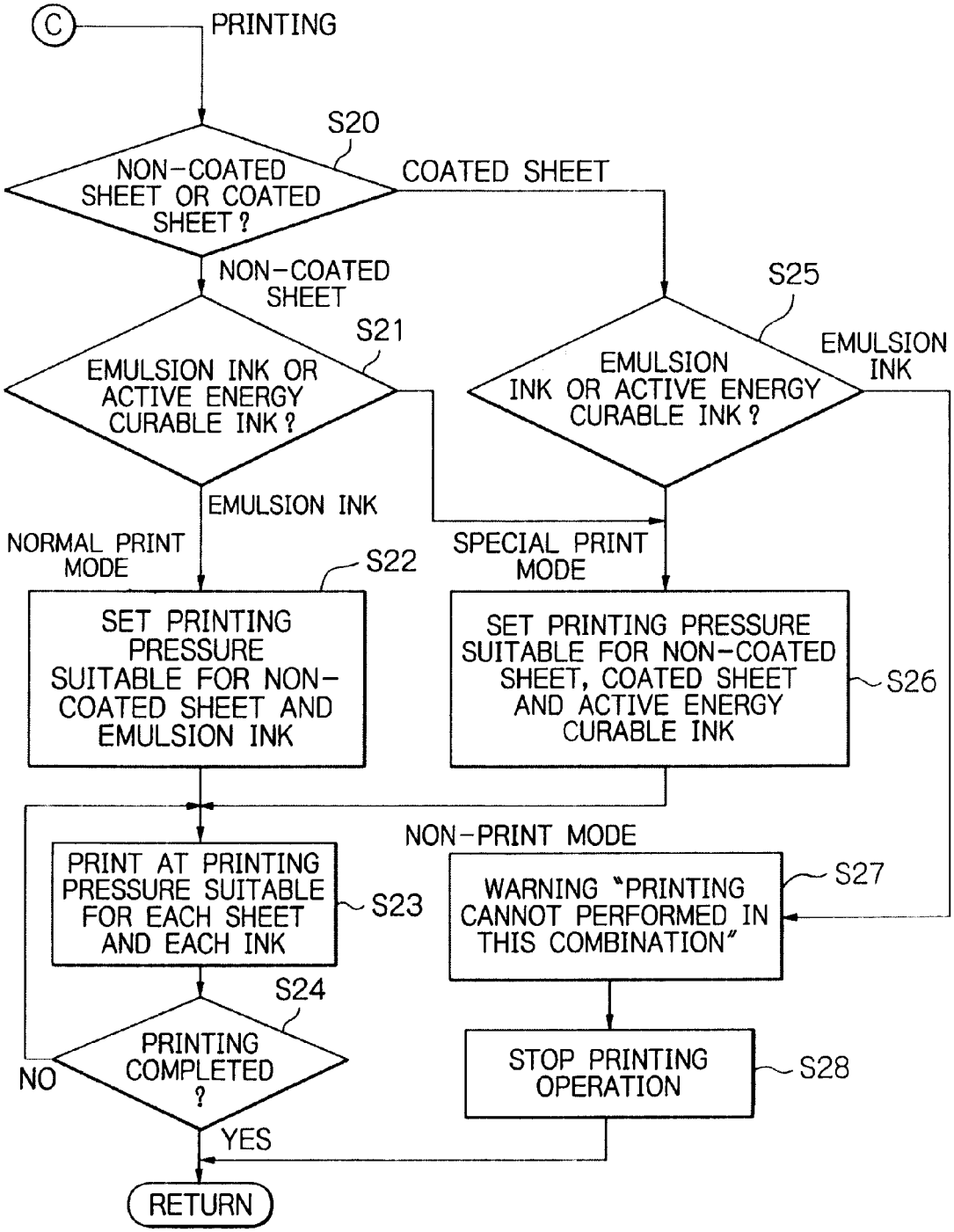
FIG. 9 is a flowchart showing a printing operation of the present embodiment following the plate-making operation shown in FIG. 8.

Next is described an operation of the present embodiment that is executed under a command of the CPU of the microcomputer peripheral circuit 3 of the control unit 2 shown in FIG. 4, with reference to the flowcharts of FIG. 8 and FIG. 9. In the description of this operation, only the sections related to the present invention will be described, and descriptions of the other sections are omitted as these are known sections. In both drawings, the active energy ray curable ink is abbreviated as "active energy curable ink."

First, in step S1 shown in FIG. 8, it is determined which of a plate-making operation and a printing operation is executed. When the plate-making operation is executed, the process proceeds to step S2 in which the coated sheet set key 131 or the non-coated sheet set key 132 of the coated sheet/non-coated sheet setting means (coated sheet/non-coated sheet plate-making/print mode selection setting means) described above in relation to the sheet to be used is touched, to set a coated sheet or non-coated sheet. When a non-coated sheet is set by pressing the non-coated sheet set key 132, the process proceeds to step S3 in which the ink type detecting sensor 213 determines the type of ink by detecting which of the emulsion ink and the active energy curable ink is filled in/attached to the print drum.

On the other hand, when a coated sheet is set by pressing the coated sheet set key 131, the process proceeds to step S7 in which, as with step S3, the ink type detecting sensor 213 determines the type of ink by detecting which of the emulsion ink and the active energy curable ink is filled in/attached to the print drum.

In step S3 and step S7, there are three types of modes to be selected, and the plate-making setting is classified as follows. Specifically:

Normal plate-making mode: This is a mode in which the non-coated sheet is set, the emulsion ink is detected, and perforation/plate-making operation is executed using the normal plate-making (conventional plate-making) method by means of the second control means (step S4).

Special plate-making mode: This is a mode in which the non-coated sheet is set and the active energy curable ink is detected, or the coated sheet is set and the active energy curable ink is detected. In this mode, the following perforated state of the present invention is obtained. Specifically, in this perforated state, a perforated pattern is obtained in which perforated holes are formed in different lines running in the main scanning direction S by the first control means causing the odd bits and even bits of heat generators 9 of the thermal head 10 to perform heating and driving, and in which the perforated holes obtained by heating and driving the adjacent odd bits and even bits are not arranged adjacent to each other in the same line in the main scanning direction S (step S8).

Non-plate-making mode: This is a mode in which the coated sheet is set, the emulsion ink is detected, and a warning/display, such as "plate-making cannot be performed in this combination," is displayed/reported on the LCD screen of the touch panel 98 shown in FIG. 3, and the plate-making operation is stopped (step S9, step S10). In this mode, the emulsion ink needs to be infiltrated and dried, hence when the coated sheet is used the ink does not infiltrate. Therefore, the ink cannot be fixed in this combination, and the resulting sheet cannot be used as a printed matter, hence the plate-making operation is stopped. Therefore, setting of the above-mentioned three types of modes is the initial setting in the present embodiment (present invention) and can be changed. Moreover, the abovementioned three types of plate-making modes are set by the plate-making method selection means of the thermal head drive control unit 5 shown in FIG. 4.

Next, the plate-making is performed and completed using the contents of the normal plate-making or the special plate-making mode (steps S5 and S6). When the process is shifted to the printing operation, printing pressure corresponding to each mode is set to execute printing or to output a warning.

Specifically, when executing the printing operation shown in FIG. 9, the process proceeds to step S20 in which it is determined which of the coated sheet and the non-coated sheet is set as the sheet to be used. When the non-coated sheet is set, the process proceeds to step S21 in which the type of ink is determined by detecting which of the emulsion ink and the active energy curable ink is filled in/attached to the print drum.

On the other hand, when the coated sheet is set, the process proceeds to step S25 in which the type of ink is determined by detecting which of the emulsion ink and the active energy curable ink is filled in/attached to the print drum.

In step S21 and step S25, there are three types of modes to be selected in accordance with the plate-making modes shown in FIG. 8, and the printing operation setting is classified as follows. Specifically:

Normal print mode: This is a print mode corresponding to the normal plate-making mode, wherein the non-coated sheet is set and the emulsion ink is detected. In this mode, the printing pressure control motor (14) of the printing pressure variable means 520 is controlled by the printing pressure variable control means 6 shown in FIG. 4, and thereby preferred printing pressure is set when performing printing using the emulsion ink (step S22).

Special print mode: This is a print mode corresponding to the special plate-making mode, wherein the non-coated sheet is set and the active energy curable ink is detected, or the coated sheet is set and the active energy curable ink is detected. In this mode, the printing pressure control motor (14) of the printing pressure variable means 520 is controlled by the printing pressure variable control means 6 shown in FIG. 4, and thereby preferred printing pressure is set when performing printing using the emulsion ink (step S26).

Here, when using the active energy curable ink having higher ink cohesive force and tack value than the emulsion ink and the coated sheet having high smoothness, adherence force between the master and the sheet is increased, hence there is a possibility of the occurrence of printing wrinkles in which a printed image defect is generated in the form of white stripes. Therefore, when setting the printing pressure, the printing pressure for the special plate-making mode is set lower than the printing pressure for the normal print mode. At this moment, the sheet may be largely classified into the non-coated sheet and the coated sheet, but printing pressure setting may be performed in detail by further classifying the coated and non-coated sheets.

Next, printing is performed and completed (steps S23 and S24) at the set printing pressure (set by step S22 or S26).

Non-print mode: This is a print mode corresponding to the non-plate-making mode, wherein the coated sheet is set and the emulsion ink is detected. In this mode, a warning/display, such as "printing cannot be performed in this combination," is displayed/reported on the LCD screen of the touch panel 98 shown in FIG. 3, and the printing operation is stopped (step S27, step S28). Also, the emulsion ink needs to be infiltrated and dried, hence when the coated sheet is used the ink does not infiltrate. Therefore, the ink cannot be fixed in this combination, and the resulting sheet cannot be used as a printed matter, hence the printing operation is stopped. The above-mentioned three types of print modes are set by the plate-making method selection means of the thermal head drive control unit 5 shown in FIG. 4.

EXAMPLE 1

Figure 10:
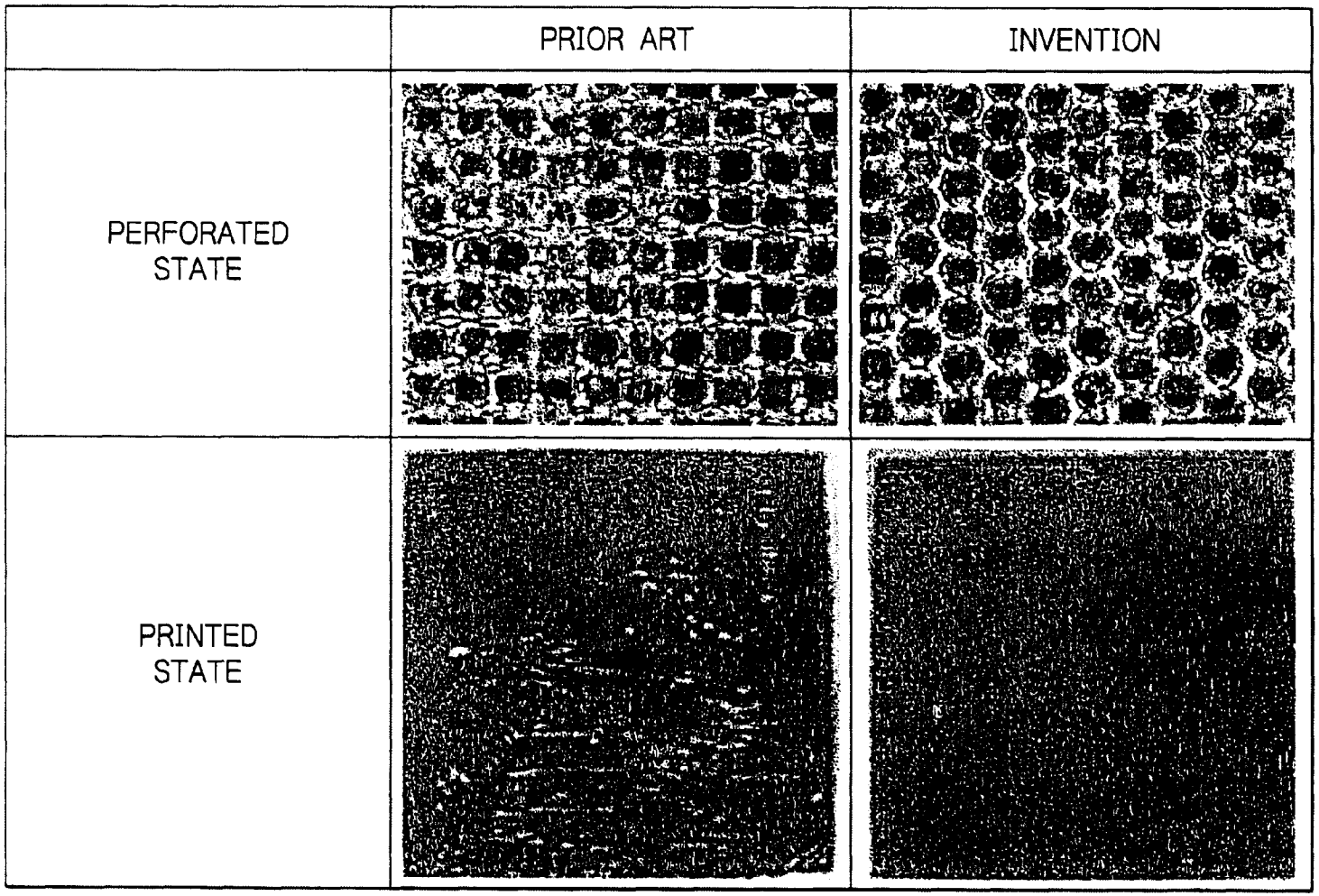
FIG. 10 is a picture showing Example 1, wherein the left side of the drawing shows the perforated state of the master obtained in the conventional normal plate-making mode and a printed state obtained when performing printing on a coated sheet using this master, and the right side of the drawing shows the perforated state of the master obtained in the special plate-making mode of the present embodiment (present invention) and the printed state obtained when performing printing on a coated sheet using this master.

Next, FIG. 10 is used to describe Example 1 related to plate-making/printing executed in the special plate-making mode by the first control means and in the conventional normal plate-making mode by the second control means. In the present example, the perforated state (perforated pattern) obtained by executing the conventional normal plate-making mode and the printed state obtained when printing is performed on the coated sheet are compared with the perforated state obtained by executing the special plate-making mode of the present embodiment (present invention) and the printed state obtained when printing is performed on the coated sheet, and printing wrinkles that are generated due to floating of the used master during printing in a combination of the active energy ray curable ink and the coated sheet are described.

The photograph shown in FIG. 10 shows the perforated state (perforated pattern) obtained when a 33×33 mm solid image is subjected to perforation/plate-making, and the printed state obtained when printing is performed on the coated sheet. The photograph shown on the left side of the drawing shows a perforated state (perforated pattern) obtained in a combination of the coated sheet and the active energy ray curable ink in the conventional normal plate-making mode, and a printed matter printed on the coated sheet, the printed matter being completely fixed using the active energy ray curing fixing device 201 shown in FIG. 1. The photograph shown on the right side of the drawing, on the other hand, shows a perforated state (perforated pattern) obtained in a combination of the coated sheet and the active energy ray curable ink in the special plate-making mode of the present embodiment (present invention), and a printed matter printed on the coated sheet, the printed matter being completely fixed as well by using the active energy ray curing fixing device 201. The active energy ray curing fixing device 201, specifically, uses an ultraviolet irradiation fixing device.

The summary of common plate-making/printing conditions for executing the abovementioned plate-making/printing will be described hereinafter. Both plate-making and printing were executed under the same printing pressure, without performing printing pressure variable control using the printing pressure variable control means 6 shown in FIG. 4.

Environmental conditions: Temperature 23 C. °, Humidity 41% RH

Plate-making resolution: Resolution in the main scanning direction of the thermal head . . . 600 dpi, Resolution pitch in the sub-scanning direction of the master (feed pitch) . . . 600 dpi Image pattern (perforated pattern): Solid Used master: "Type I master," manufactured by Ricoh Company, Ltd. . . . The master described in above Japanese Published Unexamined Patent Application No. H10-147075, which has a thermoplastic resin film, at least one layer of porous resin membrane, and porous support body Used ink: The active energy ray curable ink for stencil printing, which was experimentally produced for this experiment. Ultraviolet curable ink was used as the active energy ray curable ink.

Print sheet: Pearl-coated sheet 68k, manufactured by Mitsubishi Paper Mills Limited.

Stencil printing apparatus: "Satelio A650, remodeled version," manufactured by Ricoh Company, Ltd.

The left side of FIG. 10, which was obtained by performing printing under the above conditions, shows a printed matter that is printed on the coated sheet by means of the engraved master that has the perforated state obtained in the combination of the coated sheet and the active energy ray curable ink in the conventional normal plate-making mode, the printed matter being completely fixed using the active energy ray curing fixing device 201. Therefore, an image defect in the form of white stripes is generated in the horizontal direction of the solid parts of the subject solid image. On the other hand, the right side of FIG. 10 shows a printed matter that is printed on the coated sheet by means of the engraved master that has the perforated state obtained in the combination of the coated sheet and the active energy ray curable ink in the special plate-making mode of the present embodiment (present invention), the printed matter being completely fixed as well by using the active energy ray curing fixing device 201. Therefore, it is clear that the solid image does not have any problems.

The reasons of the occurrence of printing wrinkles in which the printed image defect is generated in the form of white stripes can be, first, that the coated sheet has higher smoothness than the non-coated sheet, and thus the adherence force between the sheet and the master is high, and, secondly, that the active energy ray curable ink generally has higher cohesive force and tack value than the abovementioned emulsion ink, and thus the adherence force between the sheet and the master is high. Therefore, the solid parts are gradually drawn toward the backward side of conveyance of the engraved master during printing, i.e., toward the backward side of delivery of the printed image, and at first bending occurs due to floating of the engraved master. Then, the engraved master gradually stretches, sags and is thrown into folds, whereby printing wrinkles (image with white stripes) caused due to floating of the master is generated. Such phenomena were confirmed in the experiment. The printing wrinkle is a significant problem and an unacceptable flaw in the stencil printing apparatus.

Figure 11:
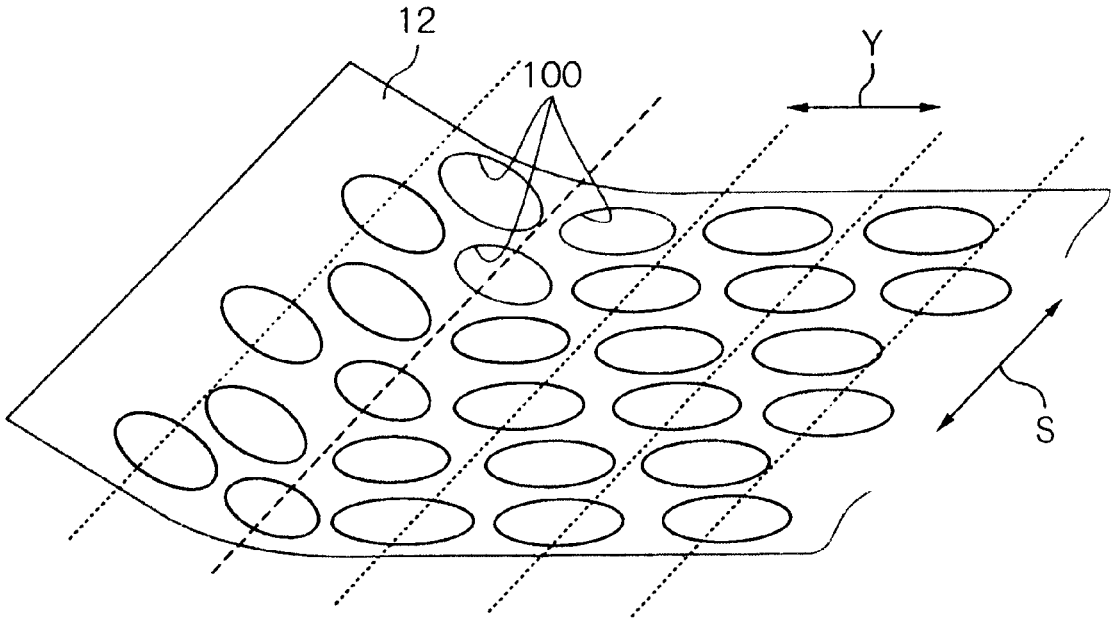
FIG. 11 is a diagram for explaining the area of a remaining width size (non-image portion) between perforated holes adjacent to each other in a main scanning direction, the remaining width size being obtained when bending the perforated state of the engraved master obtained in the special plate-making mode of the present embodiment (present invention)
Figure 12:
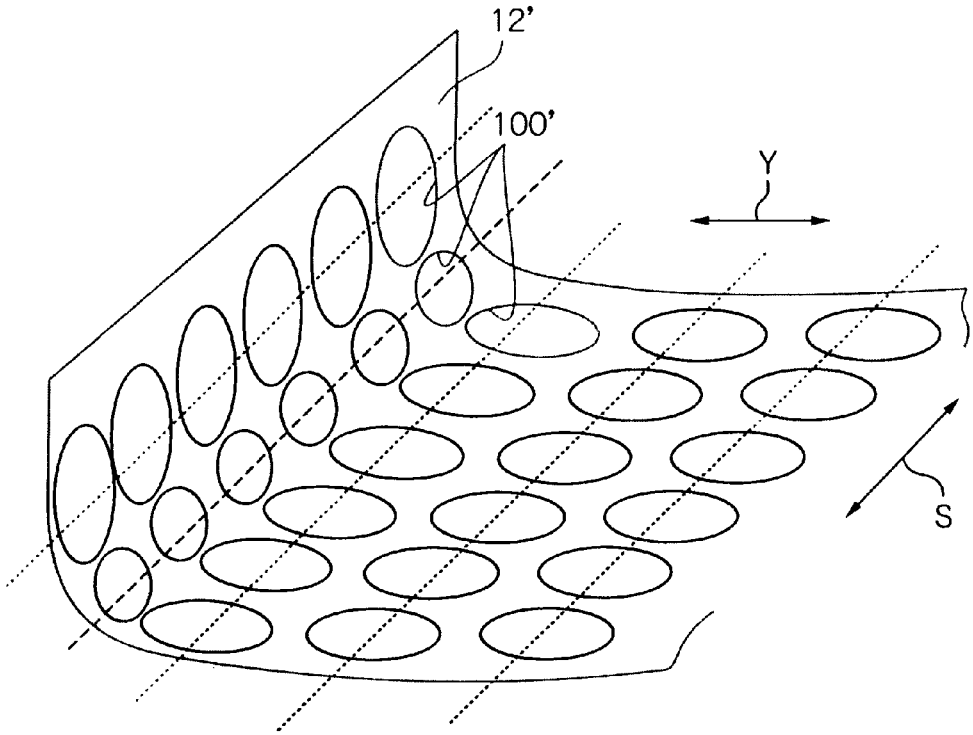
FIG. 12 is a diagram for explaining the area of a remaining width size (non-image portion) between perforated holes adjacent to each other in the main scanning direction, the remaining width size being obtained when bending the engraved master obtained in the conventional normal plate-making mode.

However, a perforated pattern obtained by performing melt perforation using each heat generator of the thermal heat in the present embodiment (present invention) is characterized in that perforated holes to be formed on the film by heating and driving the odd bits and even bits of heat generators of the thermal head are formed in different lines running in the main scanning direction, and that the perforated holes to be formed on the film by heating and driving the adjacent odd bits and even bits are not arranged adjacent to each other in the same line in the main scanning direction. Therefore, compared to the engraved master 12' obtained in the conventional normal plate-making mode as shown in FIG. 12, in the engraved master 12 obtained in the special plate-making mode of the present embodiment (present invention) as shown in FIG. 11, the area of the film remaining portion excluding the section where the perforated holes 100 are formed (the area of a non-plate-making image portion) is wide in the main scanning direction S and thus is rigidly strong in bending, folding and the like in the main scanning direction S. Moreover, in view of the lines shown by the thick dashed lines, the number of perforated holes is small, hence the adherence force between the sheet and the master becomes weak, and eventually the effect of preventing the occurrence of printing wrinkles at the solid parts is obtained.

As described above, in the present embodiment (present invention), even when the ink to be used in the stencil printing apparatus is the emulsion ink or active energy ray curable ink for stencil printing, and even when the sheet to be used is the non-coated sheet (high-quality sheet) or coated sheet, printing wrinkles and master wrinkles are not generated by the master, and thus the stencil printing apparatus capable of obtaining preferred printed image quality can be realized and provided. In addition, the effects described in the abovementioned list of effects can be achieved in the present embodiment.

Next, a modification of the above embodiment will be described. When using a conventional normal plate-making method, adjacent bits of heat generators are heated and driven simultaneously at the time of plate making of the solid parts and the like, while when using the special plate-making method of the present embodiment (present invention), the timings of heating and driving the adjacent bits of heat generators are shifted, and thus the adjacent bits of heat generators are not heated and driven simultaneously. Therefore, when the same applied energy is applied to the thermal head, the master is perforated significantly due to the influence of the heat generated by the adjacent bits, when the conventional normal plate-making method is used. On the other hand, when the special plate-making method of the above embodiment is used, a small perforated state is obtained. Therefore, at this rate, a phenomenon in which the solid parts are not filled and decrease in printed image density are caused when printing is performed on the coated sheet or the like on which particularly the ink does not spread significantly. In view of such circumstances, the present modification was contrived to complement these situations.

Specifically, in the present modification, both the special plate-making mode and the normal plate-making mode can be realized by the first control means and the second control means respectively. When the applied energy to be applied to each heat generator 9 of the thermal head 10 by the second control means is Ea and the applied energy to be applied to each heat generator 9 of the thermal head 10 by the first control means is Eb, the relationship of $Ea \leqq Eb$ is satisfied. According to the modification, the effects described in the above list of effects are of course achieved in the present modification.

"Medium to be printed" described above, of course, includes, in a limited sense, not only the coated sheet and the non-coated sheet such as a high-quality sheet, a standard sheet and a postcard, but also, in a broad sense, a resin film sheet, a metallic sheet, glass sheet and the like.

The present invention has the following features.

(1) The first control means controls the thermal head such that perforated holes to be formed on the thermoplastic resin film by heating and driving the odd bits corresponding to the odd-numbered heat generators of the thermal head and the even bits corresponding to the even-numbered heat generators are formed in different lines running in the main scanning direction, and such that the perforated holes to be formed on the thermoplastic resin film by heating and driving the adjacent odd and even bits are not arranged adjacent to each other in the same line in the main scanning direction. Therefore, preferred printed image quality can be obtained without causing print wrinkles that are generated mainly by a combination of the active energy ray curable ink (ultraviolet ray curable ink, for example) and the coated sheet, for example.

(2) The electric conduction timing changing means changes the electric conduction timings for the odd bits and the even bits of the thermal head, and thus the effect of an aspect of the claimed invention can be achieved securely.

(3) The thermoplastic resin film is perforated by the thermal head so as to obtain perforated holes independently, hence further effects of aspects of the claimed invention can be obtained, and the one excellent in preventing the master from stretching due to plate wear when printing a number of sheets can be obtained.

(4) In the perforated state on the thermoplastic resin film obtained by the thermal head, the remaining width size between adjacent perforated holes on the thermoplastic resin film is wider than the thickness of the thermoplastic resin film, hence the effect of an aspect of the claimed invention can be achieved.

(5) The applied energy changing means changes the applied energies applied to the odd bits and the even bits of the thermal head, hence the effect of an aspect of the claimed invention can be obtained, and thin lines and the like can be printed neatly.

(6) According to the above configurations, the effect of an aspect of the claimed invention can be securely achieved.

(7) The coated sheet/non-coated sheet plate-making/print mode selection setting means can execute the plate-making and printing operations corresponding to the coated sheet and the non-coated sheet that are used as the media to be printed, hence optimal printed image quality can be obtained under the preferred conditions, even when the non-coated sheet and the coated sheet are used.

(8) Emulsion ink for a non-coated sheet can be used besides the active energy ray curable ink, hence the effect of an aspect of the claimed invention can be achieved, and preferred printed image quality can be obtained when printing is performed on particularly the non-coated sheet.

(9) The report control means controls the reporting means such as to, when the ink to be used does not match the coated sheet or non-coated sheet, report to that effect on the basis of a signal sent from the ink type detection means. Therefore, the effect of an aspect of the claimed invention can be achieved, and, because the report is automatically sent even when the user using the stencil printing apparatus mistakenly sets the print drum or the ink, the master, the ink and the medium to be printed can be prevented from being supplied wastefully.

(10) The printing pressure variable control means controls the printing pressure variable means so as to set a printing pressure value corresponding to the coated sheet or non-coated sheet when printing is performed on the coated sheet or non-coated sheet. Therefore, the effect of an aspect of the claimed invention can be achieved, and it becomes possible to obtain further preferred printed image quality such that wrinkles and damage are prevented from being generated on the non-coated sheet or the coated sheet.

(11) The master has the thermoplastic resin film and at least one layer of porous resin membrane, hence the effect of an aspect of the claimed invention can be achieved, the smoothness of the thermoplastic resin film surface of the master improves so that the risk of perforation defect can be reduced, and ink dispersibility improves. Therefore, more preferred printed image quality can be obtained.

(12) When the applied energy to be applied to each heat generator of the thermal head by the second control means is Ea and the applied energy to be applied to each heat generator of the thermal head by the first control means is Eb, the relationship of $Ea \leqq Eb$ is satisfied. Accordingly, the occurrence of printing wrinkles can be prevented, and it becomes possible to obtain printed image quality such that good solid filling and the like can be achieved even on the coated sheet or other a medium to be printed on which the ink does not spread significantly.

Various modifications will become possible for those skilled in the art after receiving the teachings of the present disclosure, without departing from the scope thereof.

What is claimed is:

1. A stencil printing apparatus, comprising:

a thermal head having a number of heat generators arranged in a main scanning direction which are directly brought into contact with a thermoplastic resin film of a master, the thermoplastic resin film subjected to melt perforation by regioselectively heating and driving each of the heat generators in response to an image signal, while relatively moving the master in a sub-scanning direction perpendicular to the main scanning direction, to obtain a perforated pattern corresponding to the image signal, the engraved master on which the perforated pattern is formed is wound around an outer peripheral surface of a print drum, ink is supplied from an inner periphery side of the print drum, an ink image corresponding to the image signal is formed on a medium to be printed by means of ink bleeding through the perforated pattern, and the ink image is completely fixed using active energy ray curable ink or emulsion ink as the ink; and first control means for controlling the thermal head so that perforated holes to be formed in the thermoplastic resin film by heating and driving with regard to odd bits corresponding to odd-numbered heat generators and even bits corresponding to even-numbered heat generators are formed in different lines running in the main scanning direction, and so that the perforated holes to be formed in the thermoplastic resin film by heating and driving with regard to the odd bits and the even bits adjacent to each other are not arranged adjacent to each other in the same line in the main scanning direction.

2. The stencil printing apparatus as claimed in claim 1, further comprising:

electric conduction timing changing means for changing electric conduction timings for the odd bits and the even bits.

3. The stencil printing apparatus as claimed in claim 1, wherein a perforated state formed in the thermoplastic resin film by the thermal head is obtained by forming perforated holes independently.

4. The stencil printing apparatus as claimed in claim 1, wherein in the perforated state formed in the thermoplastic resin film by the thermal head, the remaining width size between adjacent perforated holes in the thermoplastic resin film is wider than the thickness of the thermoplastic resin film.

5. The stencil printing apparatus as claimed in claim 1, further comprising:

applied energy changing means for changing applied energies to be applied to the odd bits and the even bits.

6. The stencil printing apparatus as claimed in claim 1, wherein the thermal head is divided into a plurality of blocks and heated and driven, and a pitch difference in the sub-scanning direction between the perforated hole that is formed in the thermoplastic resin film by each of the odd bits and the perforated hole that is formed in the thermoplastic resin film by each of the even bits is ½ of resolution of the thermal head in divided driving of the thermal head.

7. The stencil printing apparatus as claimed in claim 1, further comprising:

coated sheet/non-coated sheet plate-making/printing mode selection setting means capable of selecting and setting a plate-making/printing mode for executing plate-making and printing operations corresponding to a coated sheet and a non-coated sheet each of which is used as the medium to be printed.

8. The stencil printing apparatus as claimed in claim 7, further comprising:

printing pressure variable means for changing printing pressure when the medium to be printed is pressed against the print drum; and printing pressure variable control means for controlling the printing pressure variable means so as to set a printing pressure value corresponding to the coated sheet or non-coated sheet when performing printing on the coated sheet or non-coated sheet.

9. The stencil printing apparatus as claimed in claim 7, wherein the ink for the non-coated sheet is the emulsion ink.

10. The stencil printing apparatus as claimed in claim 7, further comprising:

ink type detection means for detecting the type of the ink;

reporting means for, when the ink to be used does not match the coated sheet or the non-coated sheet, reporting to that effect; and report control means for controlling the reporting means so as to, when the ink to be used does not match the coated sheet or the non-coated sheet, report to that effect on the basis of a signal sent from the ink type detection means.

11. The stencil printing apparatus as claimed in claim 1, wherein the master has the thermoplastic resin film and at least one layer of porous resin membrane.

12. The stencil printing apparatus as claimed in claim 1, further comprising:

second control means for controlling the thermal head so that the perforated holes to be formed in the thermoplastic resin film by heating and driving the heat generators are formed on the same line running in the main scanning direction, wherein both special plate-making and normal plate-making are executed by the first control means and the second control means, respectively, and when apply energy to be applied to each heat generator of the thermal head by the second control means is Ea and apply energy to be applied to each heat generator of the thermal head by the first control means is Eb, the relationship of $Ea \leqq Eb$ is satisfied.

* * * * *